US008265520B2

(12) United States Patent
Irie et al.

(10) Patent No.: US 8,265,520 B2
(45) Date of Patent: Sep. 11, 2012

(54) IMAGE FORMING APPARATUS

(75) Inventors: Norio Irie, Saitama (JP); Kazuhiro Gotoh, Kasukabe (JP)

(73) Assignee: Fuji Xerox Co., Ltd., Tokyo (JP)

( * ) Notice: Subject to any disclaimer, the term of this patent is extended or adjusted under 35 U.S.C. 154(b) by 233 days.

(21) Appl. No.: 12/686,110

(22) Filed: Jan. 12, 2010

(65) Prior Publication Data

US 2010/0329728 A1 Dec. 30, 2010

(30) Foreign Application Priority Data

Jun. 26, 2009 (JP) ..... 2009-152235

(51) Int. Cl.
*G03G 15/00* (2006.01)

(52) U.S. Cl. ..... 399/110

(58) Field of Classification Search ..... 399/110, 399/111, 119, 107
See application file for complete search history.

(56) References Cited

U.S. PATENT DOCUMENTS

| | | | | |
|---|---|---|---|---|
| 5,628,575 | A * | 5/1997 | Morikawa et al. | 400/693 |
| 2006/0067734 | A1 | 3/2006 | Igarashi et al. | |
| 2008/0304860 | A1 | 12/2008 | Hisada | |
| 2009/0058978 | A1 | 3/2009 | Itabashi | |
| 2009/0190955 | A1 | 7/2009 | Igarashi et al. | |

FOREIGN PATENT DOCUMENTS

| | | | |
|---|---|---|---|
| JP | 10-187002 | A | 7/1998 |
| JP | 2006-098772 | A | 4/2006 |
| JP | 2006-098776 | A | 4/2006 |
| JP | 2008-165025 | A | 7/2008 |
| JP | 2008-165027 | A | 7/2008 |
| JP | 2008-275805 | A | 11/2008 |
| JP | 2009-058729 | A | 3/2009 |

* cited by examiner

*Primary Examiner* — David Porta
*Assistant Examiner* — Faye Boosalis
(74) *Attorney, Agent, or Firm* — Sughrue Mion, PLLC

(57) ABSTRACT

An image forming apparatus includes a housing, an imaging device, a top cover, a moving device, and a state holding device. The housing has a top opening formed on a top face of the housing and a side opening formed on a side face of the housing. The imaging device is housed in the housing and includes a photosensitive body, an exposure device which exposes the photosensitive body to form an electrostatic latent image on the photosensitive body, and a developing device which develops the electrostatic latent image with a developer on the photosensitive body. The top cover is movable between an open state opening the top opening and a close state closing the top opening, the exposure device being attached to an inner face of the top cover.

17 Claims, 22 Drawing Sheets

IMAGE FORMING APPARATUS

CROSS-REFERENCE TO RELATED APPLICATIONS

This application is based upon and claims priority under 35 USC 119 from Japanese Patent Application No. 2009-152235, filed Jun. 26, 2009.

BACKGROUND

1. Technical Field

The present invention relates to an image forming apparatus.

2. Related Art

In recent years, an image forming apparatus, such as a printer and a copying machine, which uses a light emitting diode device, which has a light emitting diode (LED) as a light source, as an exposure device which forms an electrostatic latent image on a photosensitive body by exposure is to be suggested.

The image forming apparatus using this light emitting diode device generally performs the exposure based on the image information by the light emitting diode device to the photosensitive body, thereby forming an electrostatic latent image on the photosensitive body, develops the electrostatic latent image with a developer to obtain a developer image, then transfers the developer image on the photosensitive body directly or via an intermediate transfer body to a recording material, such as a recording sheet, and fixes the transferred developer image onto the recording material, thereby forming an image.

SUMMARY OF THE INVENTION

According to an aspect of the invention, an image forming apparatus includes a housing, an imaging device, a top cover, a moving device, and a state holding device. The housing has a top opening formed on a top face of the housing and a side opening formed on a side face of the housing. The imaging device is housed in the housing and includes a photosensitive body, an exposure device which exposes the photosensitive body to form an electrostatic latent image on the photosensitive body, and a developing device which develops the electrostatic latent image with a developer on the photosensitive body. The top cover is movable between an open state opening the top opening and a close state closing the top opening, the exposure device being attached to an inner face of the top cover. The moving device is movable between a first position and second position through the side opening so as to draw a part of the imaging device mounted on the moving device, the first position being set inside the housing, the second position being set outside the housing. The state holding device keeps the top cover in the open state when the moving device is moved from the first position to the second position after the top cover is opened.

BRIEF DESCRIPTION OF THE DRAWINGS

Exemplary embodiments of the invention will be described in detail based on the following figures, wherein:

FIG. 6A is an explanatory view showing a state when the configuration of a holding plate is seen from the directions of the side face and top face of the holding plate, and FIG. 6B is an explanatory view showing a state when components in a movement supporting frame are seen from the directions of the side face and top face of the holding plate;

FIG. 10 is an explanatory view showing a state when the top cover in the image forming apparatus of FIG. 1 is opened to pull out an imaging device or the like;

FIGS. 11A to 11C are top explanatory views showing an operating state in one process of the state holding device or the like;

FIGS. 12A to 12C are top explanatory views showing an operating state in another process of the state holding device or the like;

FIG. 13A is an explanatory view showing a state as seen from the side face of the regulating unit, and FIG. 13B is an explanatory view showing a state as seen from the top face of the regulating unit;

DETAILED DESCRIPTION

Hereinafter, the modes (hereinafter, simply referred to as "embodiments") for carrying out the invention will be described in detail with reference to the accompanying drawings.

Figure 1:
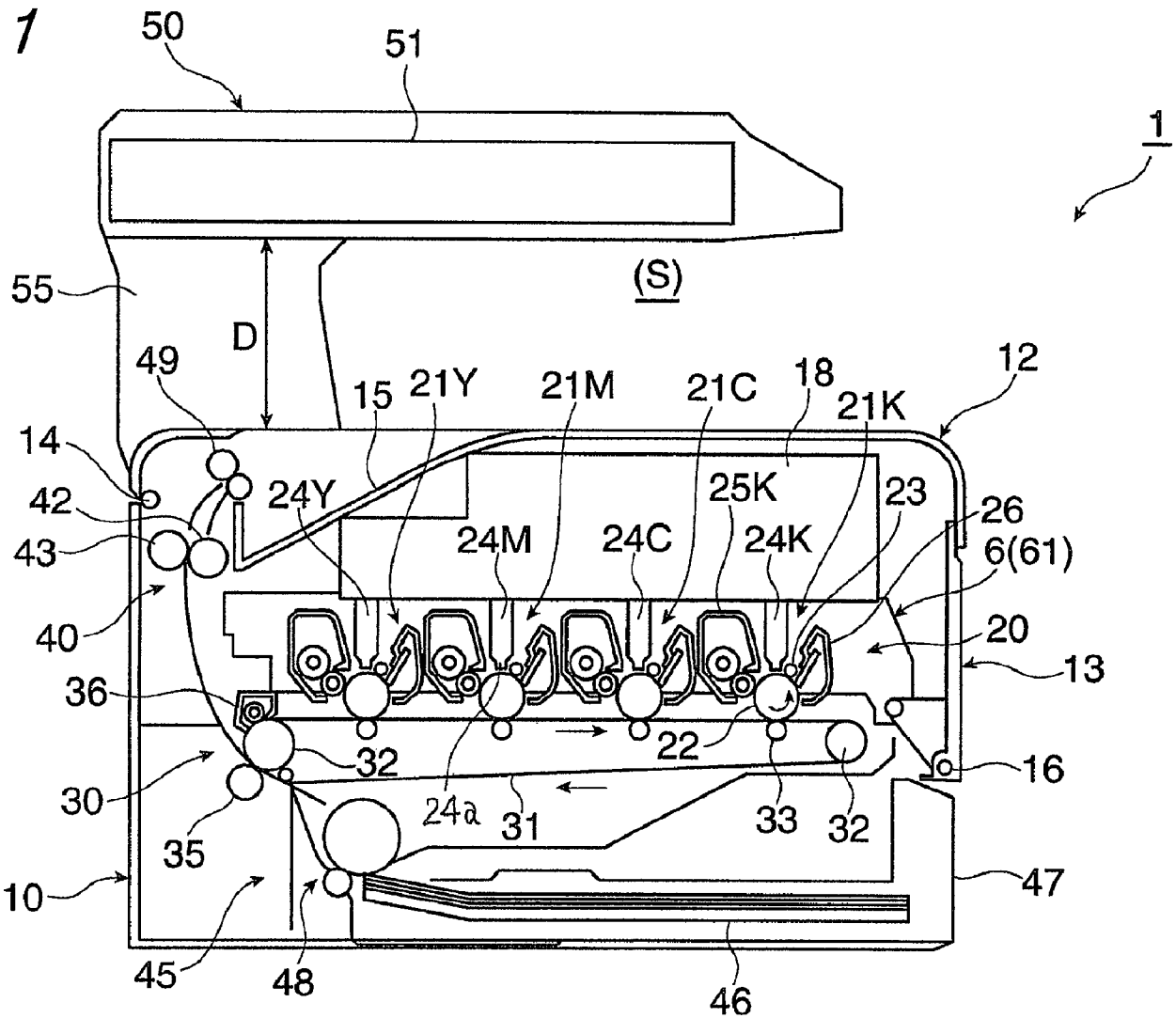
FIG. 1 is an explanatory view showing the outline of an image forming apparatus according to exemplary embodiment 1.
Figure 2:
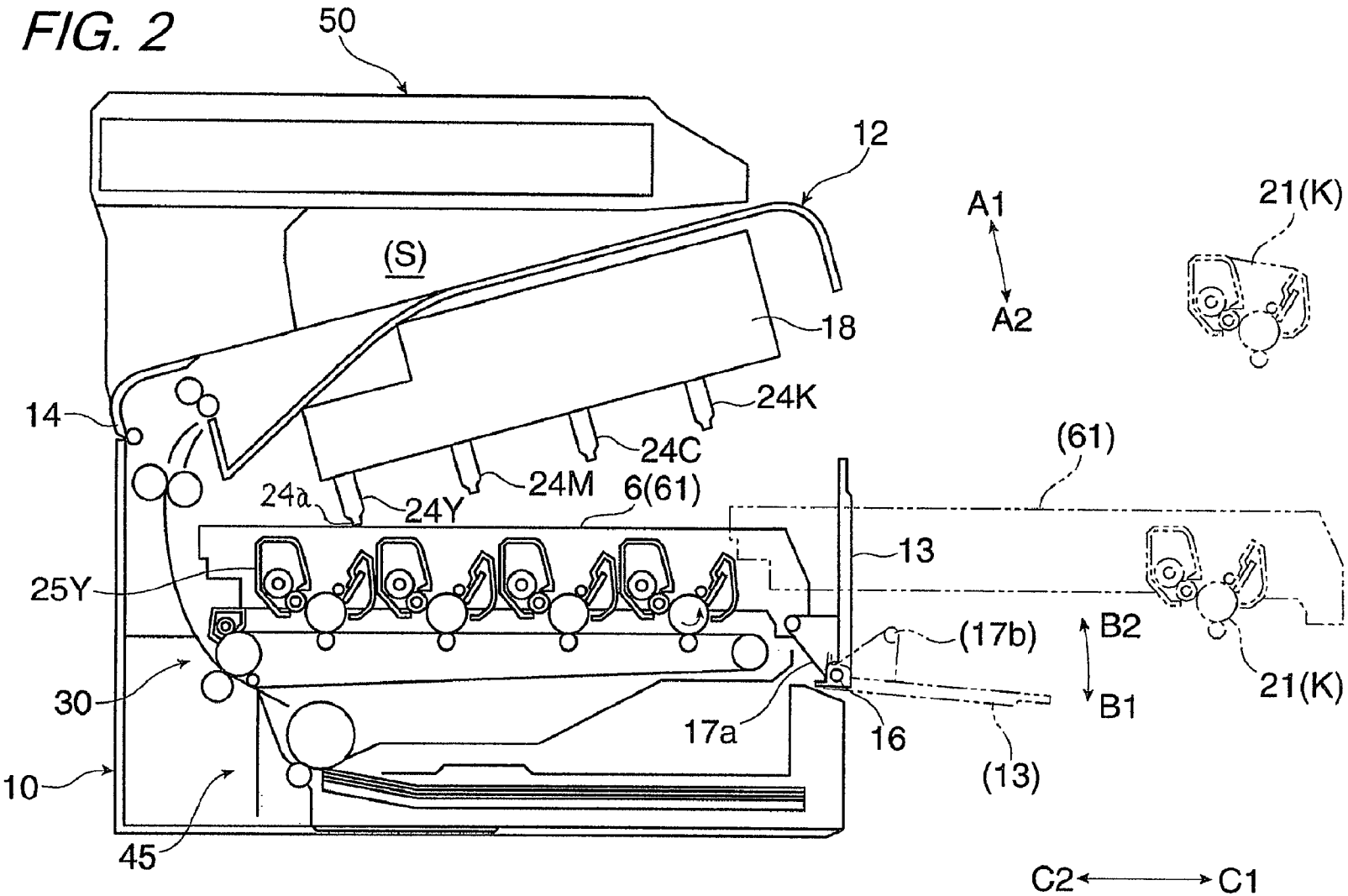
FIG. 2 is an explanatory view showing a main operating state in the image forming apparatus of FIG. 1.

FIG. 1 shows the outline of an image forming apparatus 1 according to an exemplary embodiment, and FIG. 2 shows an aspect of a change in the state of the image forming apparatus 1.

In the image forming apparatus 1 according to this embodiment, an imaging device 20, an intermediate transfer device 30, a fixing device 40, and a sheet feeder 45 are arranged inside a box-shaped housing 10, and a document reader 50 is installed outside the housing 10.

The housing 10 includes components, such as a plurality of supporting members and an external cover, and has the external appearance formed in a shape (a box shape) which resembles a box shape. The housing 10 has a top face portion formed in an open shape, and an external cover of the portion which covers a top face opening is constituted as a top cover 12 for opening and closing the top face opening. Additionally, the housing 10 has a front side face portion (a side face portion shown on the right in FIG. 1) formed in an open shape, and an external cover of the portion which covers a side face opening for opening and closing a side face opening is constituted as a front cover 13.

The top cover 12 has the structure of being opened and closed by swinging in directions shown by arrows A1 and A2 about a supporting shaft 14 arranged at one end (an end on the rear side of the apparatus) thereof. Additionally, the top cover 12 has a portion of an external surface formed as an ejection tray surface portion 15 for storing a recording sheet (46) ejected to the outside of a housing 10 after the formation of an image. The front cover 13 has the structure of being opened and closed by swinging in directions shown by arrows B1 and B2 about a supporting shaft 16 arranged therebelow. In FIG. 1 etc, reference numeral 18 designates a structure attached to the inside of the top cover 12. This structure 18 is formed as, for example, a structure to which a cartridge-type toner storage container which stores the toner to be supplied to a developing device (25) which will be described is detachably mounted.

The imaging device 20 is arranged substantially in a central portion inside the housing 10, and includes four imaging units 21Y, 21M, 21C, and 21K which form developer (toner) images in four colors, i.e., yellow (Y), magenta (M), cyan (C), and black (K), respectively, by an electrophotographic method or the like. The respective imaging units 21 (Y, M, C, K) are arranged serially at required intervals, and all of them include a photosensitive drum 22, a charging device 23, an LED exposure device 24, the developing device 25, a cleaning device 26, etc.

Among them, the photosensitive drum 22 is obtained by forming a photoconductive layer made of an organic sensitive material or the like on the outer peripheral surface of a cylindrical drum base, and is installed so as to rotate at a required speed. The charging device 23 applies a required charged voltage to a roll-shaped charging member which comes into contact with the outer peripheral surface of the photosensitive drum 22, thereby charging the outer peripheral surface of the photosensitive drum 22 to a required potential.

The LED exposure device 24 is constituted by optical components, such as a plurality of LEDs and condensing focus lenses, and is an exposure device in which the optical components arranged at the distal end thereof are made to face the outer peripheral surface of the photosensitive drum 22 at a required distance therefrom, and the plurality of LEDs are arrayed along an axial direction of the photosensitive drum. The LED exposure device 24 exposes the charged photosensitive drum 22 on the basis of the image information to be input by the image forming apparatus, thereby forming an electrostatic latent image in which the potential of the exposed charged portion has been changed. The developing device 25 supplies a developer (toner) of a required color to the electrostatic latent image formed on the photosensitive drum 22, thereby making the developer adhere to the drum electrostatically to form a visualized toner image. The cleaning device 26 is a drum cleaning device which removes unwanted substances, such as the toner which remains on and adheres to the outer peripheral surface of the photosensitive drum 22.

The intermediate transfer device 30 is arranged at a position below the imaging device 20, and is constituted using an intermediate transfer belt 31 to which respective color toner images formed by the four imaging units 21 (Y, M, C, K) are transferred. The intermediate transfer belt 31 is constituted by an endless belt having semi-conductivity, is rotatably supported by a plurality of supporting rollers 32, and is arranged in a state where the portion thereof which exists between supporting rollers 32 passes through transfer portions of the photosensitive drums 22 of the imaging units 21 (Y, M, C, K) sequentially.

In FIG. 1 etc, reference numeral 33 designates a primary transfer device which transfers a toner image on each photosensitive drum 22 to the intermediate transfer belt 31. The primary transfer device 33 applies a required primary transfer voltage to roller-shaped members (primary transfer roller etc) which presses the intermediate transfer belt 31 against the transfer portion of the photosensitive drum 22 of each imaging unit 21 (Y, M, C, K), thereby bringing them into contact each other. Additionally, reference numeral 35 designates a secondary transfer device which transfers a toner image transferred by the intermediate transfer belt 31 to a recording sheet 46 as a recording material. The secondary transfer device 35 applies a required secondary transfer voltage to roller-shaped members (secondary transfer rollers etc) which presses the recording sheet 46 against the portion of the intermediate transfer belt 31 stretched over one belt supporting roller 32. Reference numeral 36 designates a belt cleaning device which removes the unwanted substances, such as toner which remains on and adheres to the intermediate transfer belt 31.

The fixing device 40 is arranged in a position (a position obliquely above the secondary transfer device 25) obliquely above one end (the imaging unit 21Y which forms a yellow toner image) of the imaging device 2 inside the housing 10. The fixing device 40 is constructed by installing inside a frame (not shown) a roller-shaped or belt-shaped heating, rotary body 42 which is rotationally driven in a predetermined direction and of which the surface temperature is heated to and maintained at required temperature by a heating generating portion, a roller-shaped or belt-shaped pressing rotary body 43 which is driven in contact with the heating rotary body at a required pressure so as to extend substantially along the direction of the rotational axis of the heating rotary body 42, etc.

The sheet feeder 45 is arranged in a position below the intermediate transfer device 30 below the imaging device 20 inside the housing 10. The sheet feeder 45 is attached to be drawable to the housing 10, and mainly includes a sheet-receiving body 47 which receives the recording sheet 46 of a desired size, kind, etc. in a stacked state, and a feeding device 48 which feeds the recording sheet 46 one by one from the sheet-receiving body 47. A sheet conveying path where a conveying roller pair 49 which conveys the recording sheet 46, a guide material which guides a conveyance destination of the recording sheet 46, etc. are installed, is provided between the sheet feeder 45 and the secondary transfer device 35, between the secondary transfer device 35 and the fixing device 40, and between the fixing device 40 and an ejection tray surface portion 17.

The document reader 50 is a device which reads an image on a document having an image (information) to be imaged, and is installed at a required space S from the top face of the housing 10, actually, from the external surface of the top face front cover 13. The document reader 50, for example, is provided at a required distance D from an outside topmost portion of the top face front cover 13 via a supporting member 55. The supporting member 55 may be a member separate from housing 10, or may be formed as a portion of the housing 10.

Additionally, the document reader 50 includes a transparent document platen on which a document is placed, a document pressing plate which presses the document against the transparent document platen, an imaging device 51 which reads the document placed on the transparent document platen while illuminating the document, etc. The document reader 50 is finally covered with the external cover, the document pressing plate, etc. The image information (signal) read by the document reader 50 is transmitted to an image processing part (not shown) which is installed inside the housing 10 of the image forming apparatus 1. Additionally, an image signal after being processed by the image processing part is finally fed to the LED exposure device 25.

In the image forming apparatus 1, as shown in FIG. 2, etc., the respective LED exposure devices 24 (Y, M, C, K) which are portions which constitute four imaging units 21 (Y, M, C, K) of the imaging device 20 are attached to the inner surface side of the top cover 12 in a state where the exposure devices are fixed to the cover. Additionally, the photosensitive drum 22, the charging device 23, the developing device 25, and the cleaning device 26 (hereinafter referred to as "mounted components") which are portions which constitute the four imaging units 21 (Y, M, C, K) are attached to the moving device 6 for drawing the mounted components out of the housing 10 or pushing the mounted components into the housing 10 in a state where they are mounted on the moving device. Accordingly, by moving out the moving device 6 so as to be drawn out, the mounted components in the four imaging units 21 are exposed to the outside of the housing 10. In this state, it is possible to perform the maintenance operation or replacement operation of the mounted components.

As shown in FIGS. 2 to 5, etc., the moving device 6 includes a movement supporting frame 61 having an attachment structure on which the four imaging units 21 (Y, M, C, K) are detachably mounted. The movement supporting frame 61 is, for example, a frame member formed so as to have a substantially oblong shape as a whole. The movement supporting frame 61 is movably attached by fitting supporting projections 62 and 63 (refer to FIG. 9, etc.) which are formed while projecting to right and left side face portions in a drawing direction C1 into a set of upper and lower guide rails 65 and 66 fixed to (a supporting member, etc. of) the housing 10. Accordingly, the movement supporting frame 61 is adapted to move between a mounting completion position (P1) set inside the housing 10 while being guided by the guide rails 65 and 66, and a drawing completion position (P2) set outside the housing 10, in a state where the frame passes through the side face opening of the housing 10.

The mounting completion position (P1) is a position when a primary transfer portion of the photosensitive drum 22 in each imaging unit 21 (Y, M, C, K) moves to the position which faces the primary transfer device 33 of the intermediate transfer device 30. In this embodiment, the supporting projections 62 and 63 of the movement supporting frame 61 are set as positions when the projections have entered and stopped at the lower ends of downwardly inclined guide portions 65*a* and 66*a* formed at deep ends (upstream ends in the drawing direction C) of the guide rails 65 and 66. On the other hand, the drawing completion position (P2) is a position when the supporting projections are drawn to a state (place) where the attachment/detachment operation of the four imaging units 21 (Y, M, C, K) with respect to the movement supporting frame 61 is at least allowed. In this embodiment, the supporting projection 62 of the movement supporting frame 61 is set as a position when the projection has moved to and stopped at a drawing stop position formed near the front end of the guide rail 65. For this reason, the drawing completion position (P2) also corresponds to a drawing stop position.

The guide rails 65 and 66 are formed substantially along the drawing direction C1 in a state where the portions excluding the above downwardly inclined guide portions 65*a* and 66*a* have extended to the height of the upper ends of the downwardly inclined guide portions. These portions become guide portions for allowing the imaging device 20 (photosensitive drum 22 in each imaging unit 21) to be displaced to a position separated from the intermediate transfer device 30 (intermediate transfer belt 31). A position where the movement supporting frame 61 (the imaging device 20) exists at the upper ends of the downwardly inclined guide portions of the guide rails 65 and 66 is defined as a separation completion position (P3). In Embodiment 1, the movement supporting frame 61 (imaging device 20) is set so as to be moved to the separation completion position (P3) by the operation of opening the front cover 13 to a predetermined angle ($\alpha$).

Additionally, the movement supporting frame 61 has a structure in which its downstream end in the drawing direction C1 is connected with the inner surface portion of the front cover 13. That is, the movement supporting frame 61 is brought into a state where a shaft portion 17*b* provided at the distal end of a protruding portion 17*a* formed on the inner surface of the front cover 13 is hooked on a recessed portion formed at the downstream end in the drawing direction C1. Accordingly, when the front cover 13 is swung in the direction of an arrow B1 about on a supporting shaft 16 in order to open the cover, as shown in FIG. 2, etc., the movement supporting frame 61 is interlocked by the connecting structure, and is moved and drawn by a predetermined distance C1 in the drawing direction C1. On the other hand, when the front cover 13 is swung in the direction of an arrow B2 about the supporting shaft 16 in order to close the cover, the movement supporting frame 61 is moved and pushed into by a predetermined distance in a direction (a pushing direction) C2 opposite to the drawing direction C1. For this reason, the front cover 13 also functions as a movement operating member which moves the movement supporting frame 61 of the moving device 6 after the top cover 12 is opened.

In the image forming apparatus 1, as shown in FIGS. 3 to 6, etc., when the top face front cover 13 is opened, a state holding device 7 which held the top face front cover 13 in a specific opened state is provided.

First, the state holding device 7 holds the top cover 12 when being operated for opening in a specific opened state. The state holding device 7 in Embodiment 1 holds as the specific opened state an opened state when the top cover 12 exists at a position where at least a light-emitting portion of the LED exposure device 24 (Y, M, C, K), attached to the inner surface side of the cover, from which the light at the time of light emission is finally emitted does not come into contact with the mounted components (the photosensitive drum 22, the charging device 23, the developing device 25, and the cleaning device 26 in this embodiment) of the imaging device 20 when being moved by the moving device 6.

Here, the image forming apparatus which is effective to provide the state holding device 7 has, for example, a configuration in which the LED exposure device 24 is arranged so as to exist at a position where the exposure device overlaps at least some of the mounted components of the imaging device in the movement direction (C1, C2) of the moving device 6 (becomes a hindrance on a movement course) when the top cover 12 is closed. Additionally, the above expression "when existing at a position which does not come into contact" is a position in a state where at least the light-emitting portion of the LED exposure device 24 does not come into contact with the mounted components of the imaging device 20, and includes, for example, a case where parts, such as an outer case and a positioning member in the LED exposure device 24, which do not directly participate in exposure performance, come into contact with the mounted components of the imaging device 20 such that the mounted components are not damaged.

Figure 8:
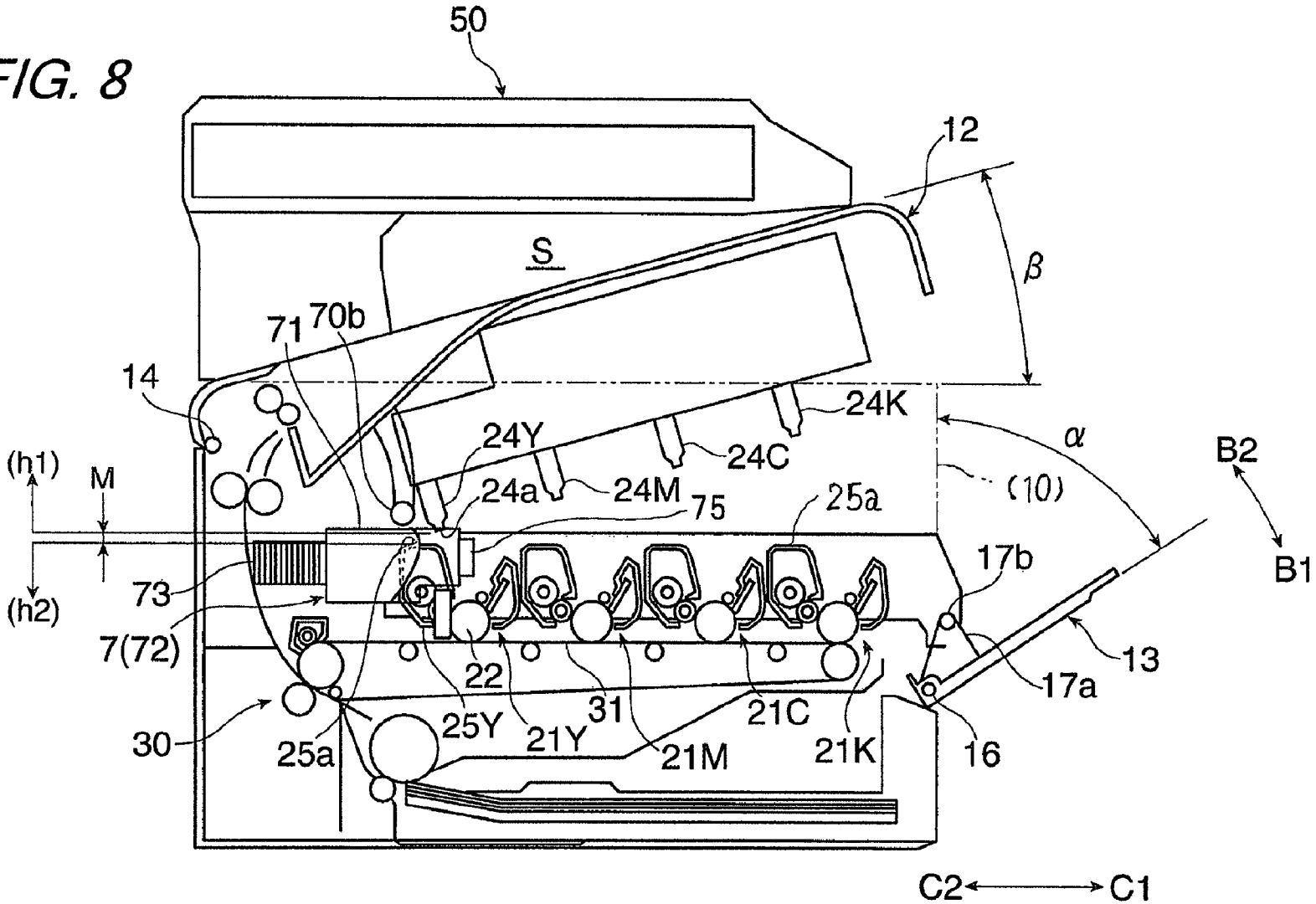
FIG. 8 is an explanatory view showing a state immediately after a front cover in the image forming apparatus of FIG. 7 is opened to a half-opened state.

As the condition when the top cover 12 in the state holding device 7 is held in a specific opened state, the state where the top cover 12 is held may be a required minimum opened state as top cover 12. The above required minimum opened state is, for example, a state where the distance (M: FIG. 8) from a mounted component which has a possibility of contacting the LED exposure device 24 is kept within a range of $0<M\leqq 15$ mm, preferably, $0<M\leqq 5$ mm. Incidentally, when the LED exposure device 24 is provided as an attachment structure which is displaced (swung) toward the upside or in the drawing direction C1 and the pushing direction C2, that is its opposite direction, it is also possible to set the distance M to 0 mm. In this case, although at least the light-emitting portion of the LED exposure device 24 can be brought slightly into contact with some of the mounted components of the imaging device 20 during its movement, the exposure device 24 is not damaged to such a degree that its exposure performance degrades due to the contact.

Such a state holding device 7 includes a supporting portion 70 which is provided on the inner surface portion of the top face front cover 13, a holding plate 72 which is formed with a holding surface portion 71 which allows the supporting portion 70 when the top face front cover 13 is opened to be placed thereon and held thereby, and which can move along the drawing direction C1, a pushing member 73 which resiliently pushes the holding plate 72 in the drawing direction C1, a stopping member 74 which stops the holding plate 72 pushed and moved by the pushing member 73 at a position where the supporting portion 70 can be placed on the holding surface portion 71, and a returning member 75 which comes into contact with the holding plate 72 when the moving device 6 in the direction C2 opposite to the drawing direction C1, and moves and returns the holding plate 72 to a position where the supporting portion 70 is not placed on the holding surface portion 71. Incidentally, in FIG. 3, etc., the front and rear positional relationship of the supporting portion 70, the holding plate 72, the stopping member 74, the returning member 75, the movement supporting frame 61 of the moving device, etc. is shown in a state different from an actual positional relationship for convenience. The correct positional relationship is shown by correct contents in explanatory views of FIG. 5, etc.

Among them, the supporting portion 70 includes two supporting arms 70*a* which are formed while protruding so as to extend downward at a required position on the inner surface side of the top face front cover 13, and a supporting projection 70*b* which is formed while protruding outward to the right and left at the lower ends of the supporting arms 70*a*. Additionally, the supporting portion 70 is formed particularly in a state where the supporting portion can exist at a position where the supporting projection 70*b* should be placed on the holding surface portion 71 in the holding plate 72, and is formed with a shape or structure which has such strength that the top cover 12 in the opened state in the state of being placed on the holding surface portion 71 can be sufficiently supported. The formation position of a root portion of the supporting arm 70*a* in Embodiment 1 is a part which has deviated closer to a central portion than an end on the side of the supporting shaft 14 of the top cover 12 by a required distance, in other words, an intermediate position in an inclined surface portion of the ejection tray surface portion 15.

Figure 4:
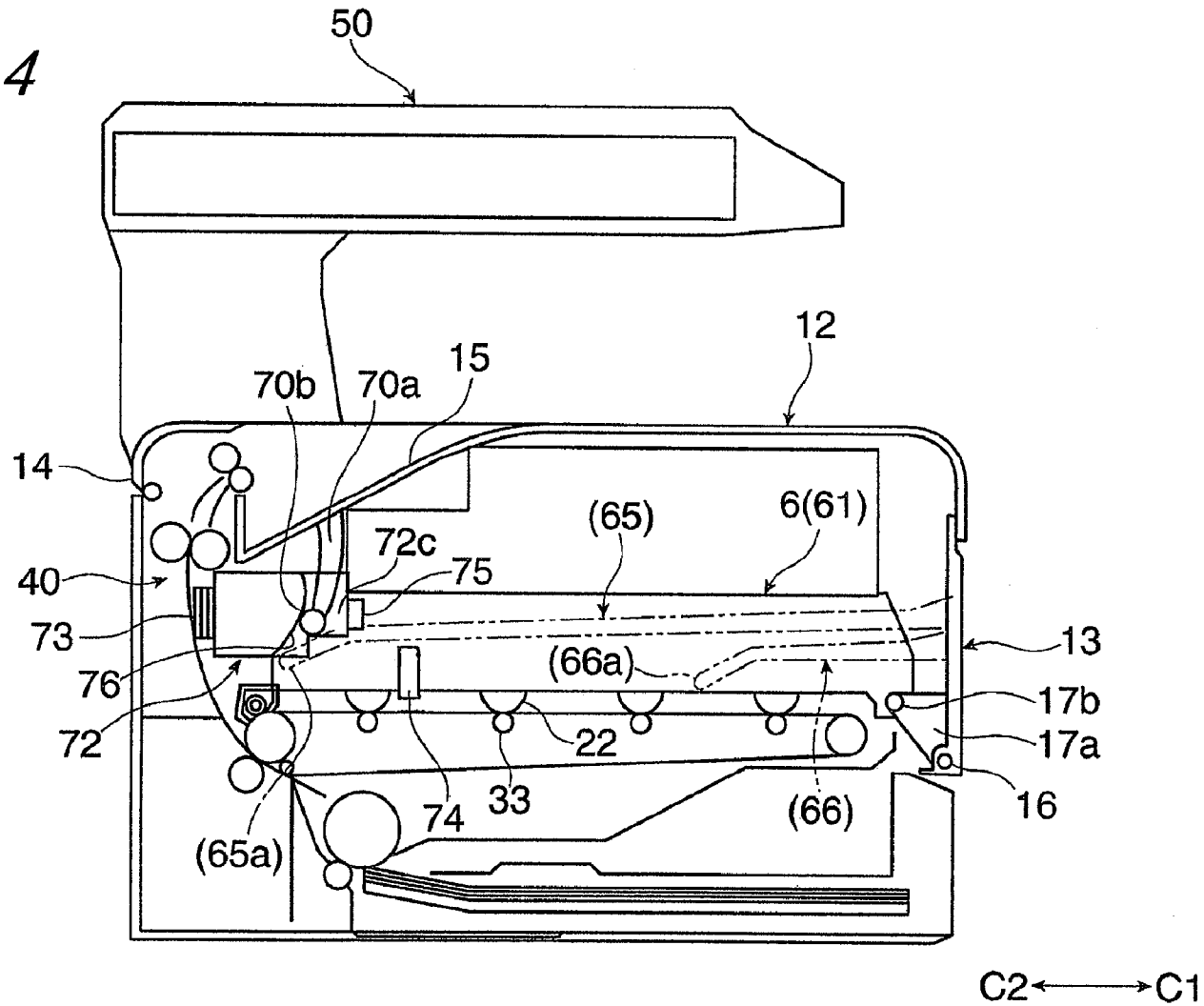
FIG. 4 is an explanatory view showing other components of the image forming apparatus of FIG. 3.
Figure 5:
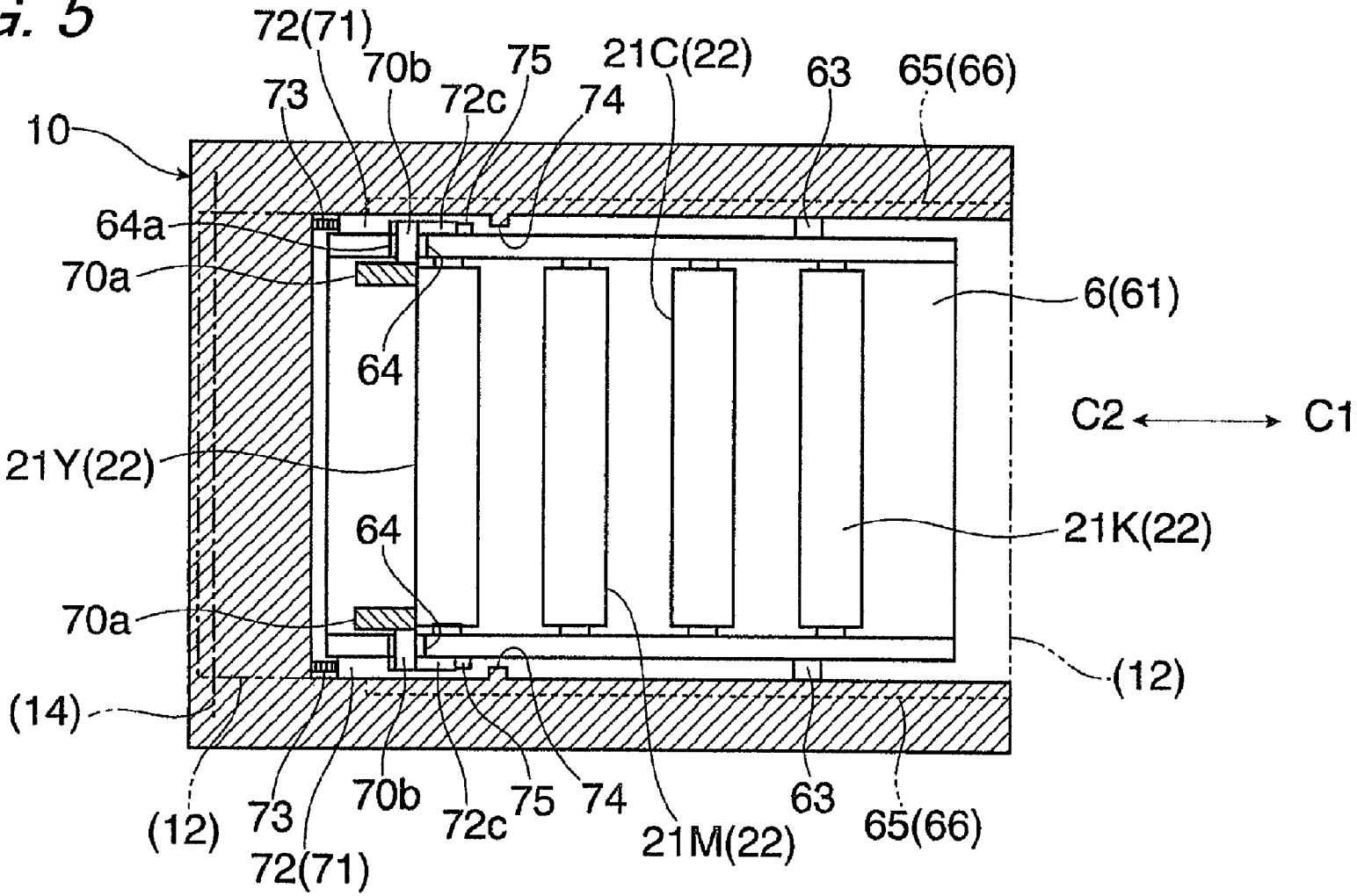
FIG. 5 is a top explanatory view showing the configuration of the state holding device or the like in the image forming apparatus of FIGS. 3 and 4.
Figure 6A:
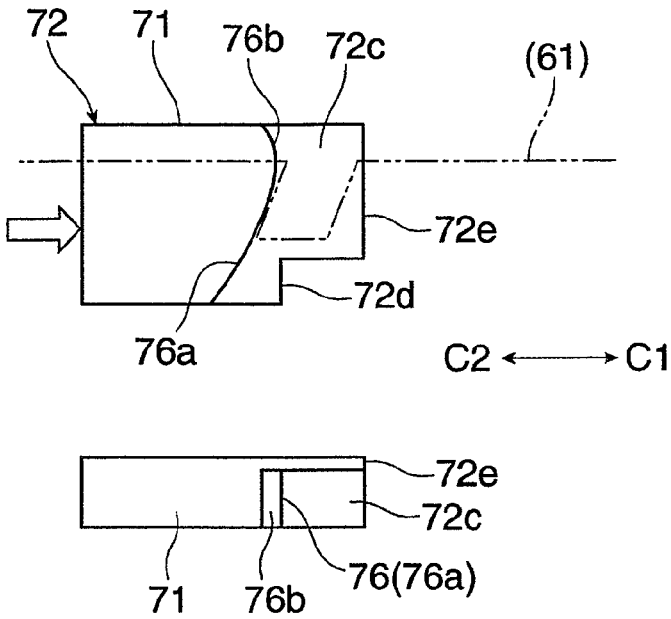
FIGS. 6A and 6B show the configuration or the like of the state holding device, and specifically.
Figure 6B:
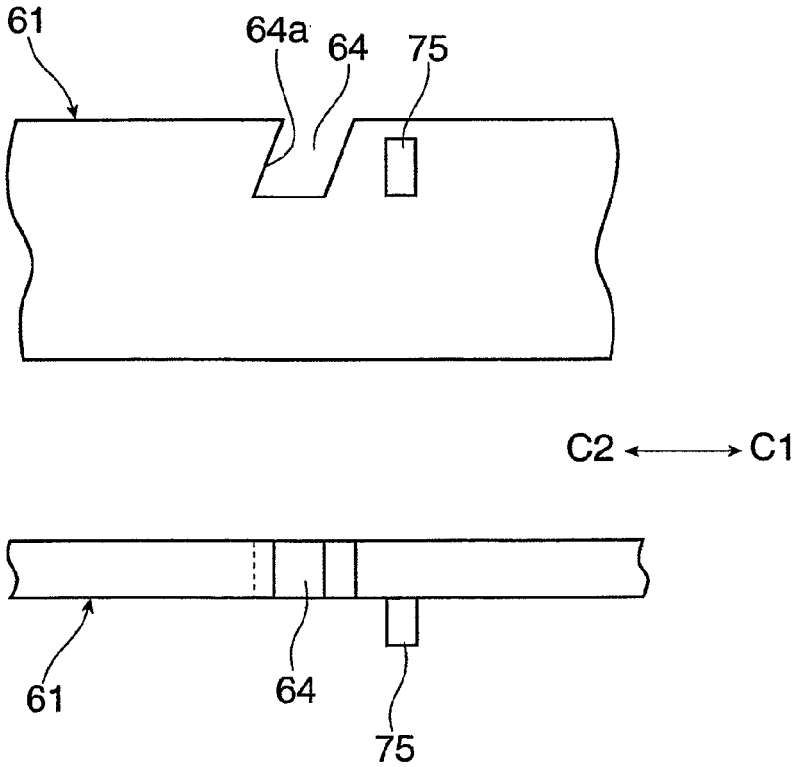

As shown in FIGS. 4 to 6, etc., the holding plate 72 includes a plate having a shape which resembles a square as a whole, and is attached to the housing 10 in a state where the holding plate can move along the drawing direction C1 of the moving device 6 via guide rails (a state where the holding plate can move in both the drawing direction C1, and the pushing direction C2 that is its opposite direction). In Embodiment 1, a set of two holding plates is used as the holding plate 72, and the holding plates 72 exist between both right and left side face portions in the movement supporting frame 61 of the moving device 6, and the housing 10, and are arranged in the state of facing upstream ends of the side face portions in the drawing direction C1, respectively. Additionally, the holding plate 72 is arranged in the state where the holding plate 72 exists between the imaging device 20 (imaging unit 21Y arranged closest to the fixing device 40), and the fixing device 40.

Additionally, an upstream portion of the upper end surface of the holding plate 72 in the drawing direction C1 is formed as a holding surface portion 71 for allowing the supporting projection 70*b* of the supporting portion 70 to be placed thereon. The holding surface portion 71 is formed so as to exists at a position (height) on which the supporting projection 70*b* of the supporting portion 70 in the top cover 12 can be placed (refer to FIG. 8) when a lowermost portion (in this embodiment, a lower distal end 24*a* of the LED exposure device 24Y for yellow which is arranged at a position where there is actually the possibility of collision) of the LED exposure device 24 which exists on the inner surface side of the top cover 12 when being in an opened state exists at (is moved to) a position apart by the required distance M from a topmost portion (in this embodiment, at an upper end 25*a* of the developing device 25Y for yellow arranged at the position where there is the possibility of collision at the time of actual movement) in the mounted components of the imaging device 20 which are moved by the movement supporting frame 61 of the moving device 6.

Additionally, the holding plate 72 is formed with a cut recessed portion 72*c* which is cut from a downstream portion of an upper end surface of the holding plate in the drawing direction C1 toward a lower end surface thereof. The cut recessed portion 72*c* is formed in such a shape that the space which does not hinder the movement of the supporting portion (supporting projection 70*b*) during the opening and closing of the top cover 12 is secured.

The cut recessed portion 72*c* in Embodiment 1 has such a shape that an inclined side face portion 76 which is inclined so as to deviate from the downstream end of the holding surface portion 71 in the drawing direction C1 to the upstream in the drawing direction C1 toward the lower end surface of the holding plate 72 exists. The inclined side face portion 76 is formed, for example, in a curved surface shape substantially corresponding to the orbit of the supporting projection 70*b* of the supporting portion 70 by the opening and closing operation of the top cover 12. Additionally, an upper portion of the cut recessed portion 72*b* is connected with the downstream end of the holding surface portion 71 in the drawing direction C1, and is formed with an inclined connecting face portion 76*b* which is inclined so as to descend as it deviates toward the downstream in the drawing direction C1.

The pushing member 73 is, for example, a coiled spring. The pushing member 73 is arranged that its one end is fixed to a portion of the housing 10 and its other end is made to abut on a portion of the holding plate 72 (a downstream side face in the drawing direction C1), and is then attached in the state of being compressed so as to exhibit a pressing force Fa which continues pushing the holding plate 72 resiliently in the drawing direction C1.

The stopping member 74 is provided in a shape which is made to protrude so as to come into contact with a downstream side face portion 72*d* of the holding plate 72 in the drawing direction C1, at the position of housing 10 on an orbit when the holding plate 72 moves in the drawing direction C1. That is, the position (SP) of the holding plate 72 stopped by the stopping member 74 is a position which exists immediately below the supporting projection 70*b* of the supporting portion 70 of the top cover 12 in a state where the holding surface portion 71 of the holding plate 72 which is pushed and moved by the pushing member 73 is opened, and where the supporting projection 71*b* of the supporting portion is stably placed on the holding surface portion 71. Although the stopping member 74 can be formed from the same material as a forming material for the housing 10, the stopping member may be formed from a material different from the forming material.

The returning member 75 is provided at a side surface portion of the movement supporting frame 61 in the moving device 6, in the state of being made to protrude so as to come into contact with a downstream side face portion 72*e* of the holding plate 72 in the drawing direction C1. The position (BP) of the holding plate 72 returned by the returning member 75 is a position where the holding surface portion 71 of the holding plate 72 does not exist immediately below the supporting projection 70*b* of the supporting portion 70 in the top cover 12, and the cut recessed portion 72*c* of the holding plate 72 exists immediately below the supporting projection 70*b* when the movement supporting frame 61 of the moving device 6 is moved in the pushing direction C2 and where the supporting projection 71*b* of the supporting portion cannot be placed on the holding surface portion 71 (in other words, the position where the supporting projection 71*b* of the supporting portion exists on the cut recessed portion 72*c* of the holding plate 72). Although the returning member 75 can be formed from the same material as a forming material for the movement supporting frame 61, the returning member may be formed from a material different from the forming material.

Here, as shown in FIG. 6A, etc., the side face portion 72*e* of the holding plate 72 is formed so as to exist at a position shifted in the pushing direction C2 from the side face portion 72*d* which comes into contact with the stopping member 74. However, the invention is not limited thereto. For example, if the condition or the like of a return position is satisfied, a face (the same face) which exists at the same position as the side face portion 72*d* may be used.

In addition, as shown in FIGS. 5 and 6, etc., the movement supporting frame 61 in the moving device 6 is formed with a recessed portion 64 which the supporting projection 70*b* of the supporting portion 70 in the top cover 12 when being closed enters and is received. The recessed portion 64 is formed at a position where the supporting projection 70*b* of the top cover 12 to be closed can move and enter when the movement supporting frame 61 is in a state where the frame has moved to the mounting completion position (P1). Additionally, an upstream side face portion 64*a* of the recessed portion 64 in the drawing direction C1 is formed as a contact surface which comes into contact with the supporting projection 70*b* of the supporting portion 70 in the top cover 12 when having been closed, thereby preventing the movement of the movement supporting frame 61 in the drawing direction C1. The supporting projection 70*b* of the supporting portion 70 in the top cover 12 at this time and the side face portion 64*a* of the recessed portion 64 in the movement supporting frame 61 constitute a movement regulating mechanism which regulates the movement of the moving device 6.

The formation of a basic image by the image forming apparatus 1 is performed as follows.

For example, when a request for the formation of a full color image constituted by combining the above four color toner images is received, in the four imaging units 21 (Y, M, C, K) in the imaging device 20, a toner image of each color (Y, M, C, K) is first formed on each photosensitive drum 22.

That is, after each photosensitive drum 22 starts its rotation, and its outer peripheral surface is charged to a required potential by the charging device 23, respectively, the exposure to the charged photosensitive drum 22 is performed by each LED exposure device 24, and an electrostatic latent image according to a color component is formed. At this time, the LED exposure device 24 performs exposure on the basis of the information (signal) on an image read by the document reader 50, thereby forming an electrostatic latent image, or performs exposure on the basis of the information on other images input from the outside of the image forming apparatus 1, thereby forming an electrostatic latent image. The electrostatic latent image formed on each photosensitive drum 22 is developed by a developer of a corresponding color and is formed as a toner image of each color when passing through each developing device 25.

Subsequently, toner images of respective colors formed in the four imaging units 21 (Y, M, C, K) are primarily transferred to the intermediate transfer belt 31 of the intermediate transfer device 30 so as to overlap each other sequentially by the primary transfer device 33. Thereafter, the toner images on the intermediate transfer device 30 are secondarily transferred to the recording sheet 46 supplied from the sheet feeder 45 by the secondary transfer device 35. Next, the recording sheet 46 to which the toner images are transferred is conveyed toward the fixing device 40 from a secondary transfer position, is introduced into a contact portion between a heating rotary body 42 in the fixing device 40, and the pressurizing rotary body 43, and when passing through the contact portion, is heated and pressurized. Accordingly, the toner images are melted and anchored, and thereby fixed on the recording sheet 46.

The recording sheet 46 after the fixation is ended is ejected from the fixing device 40, and then ejected and received toward the ejection tray surface portion 15 formed as a portion of the top cover 12 of the housing 10. By the above process, a full color image is formed on (one side of) the recording sheet 46.

Next, the operation when the maintenance operation and replacement operation of (mounted components of) the imaging device 20 in the image forming apparatus 1 are performed will be described.

When the maintenance operation and replacement operation are performed, the top cover 12 is opened, the front cover 13 is then opened, and then, the operation of pulling out the moving device 6 is performed.

Figure 7:
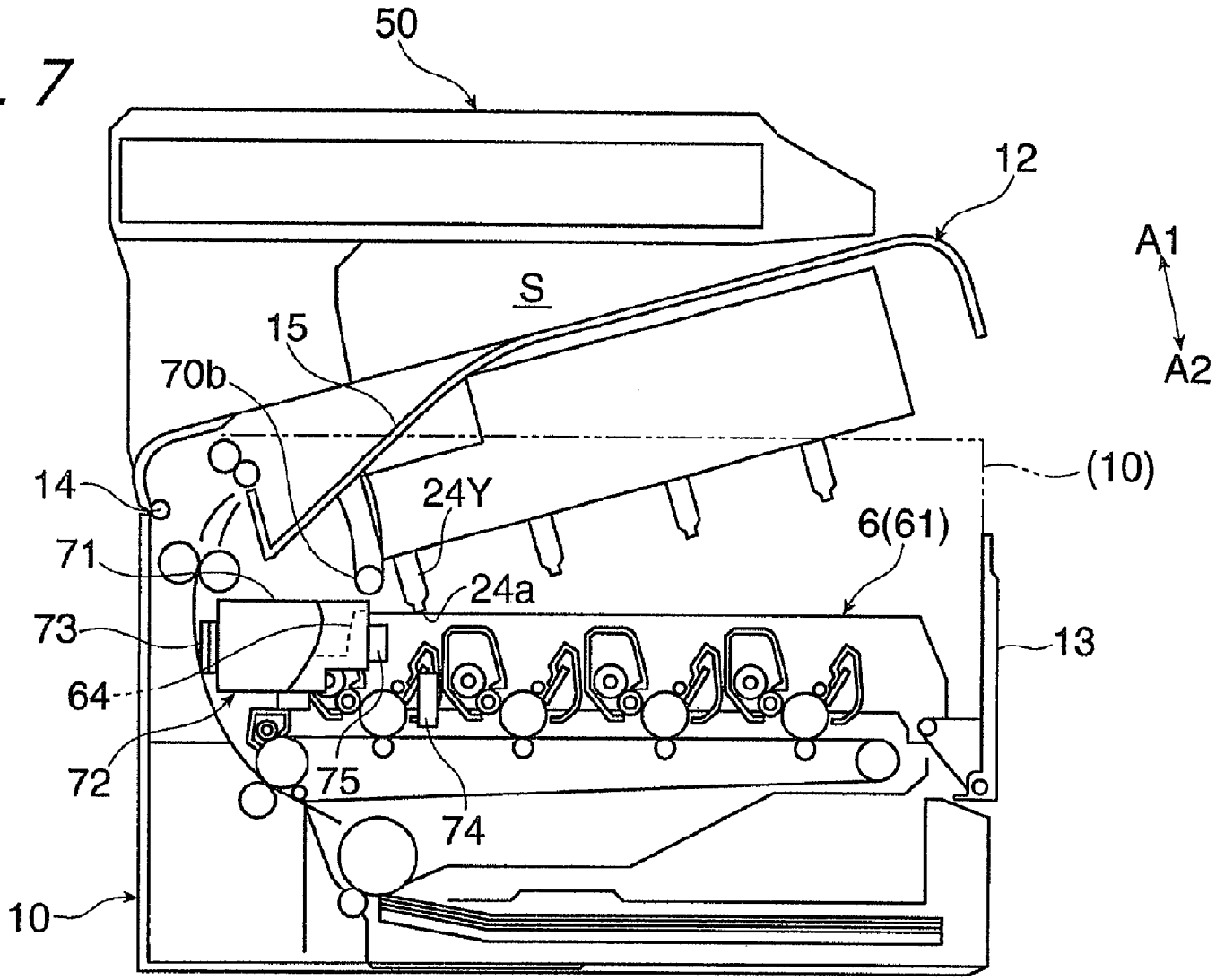
FIG. 7 is an explanatory view showing a state immediately after a top cover in the image forming apparatus of FIG. 1 is opened.

First, when a user opens the top cover 12, as shown in FIG. 7, top cover 12 is swung in a direction shown by the arrow A1 with the supporting shaft 14 as a fulcrum, and moves into a space S where the downstream portion of top cover 12 in the drawing direction C1 is formed between top cover 12 and the document reader 50.

Figure 11A:
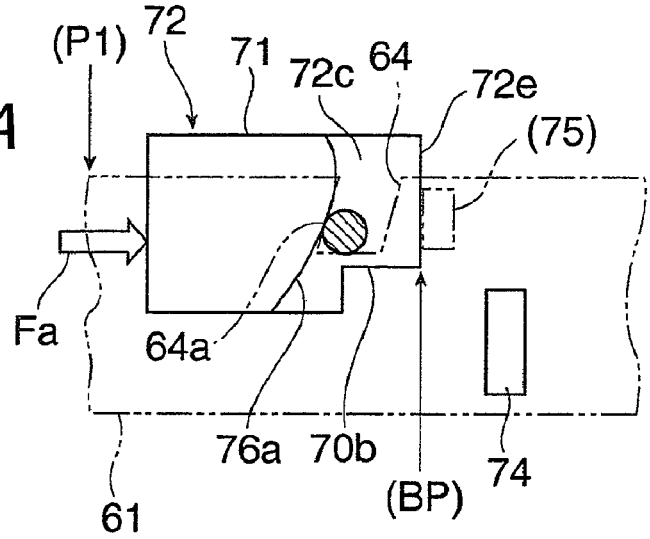

At this time, the four LED exposure devices 24 (Y, M, C, K) attached to the inside of the top cover 12 move upward so as to be lifted along with top cover 12, and are separated from the imaging units 21 (Y, M, C, K), respectively. The four LED exposure devices 24 (Y, M, C, K) at this time are put in an obliquely inclined state (a state where the LED exposure device 24 arranged at a position apart from the supporting shaft 14 has moved to a relatively higher position) in correspondence with the inclination angle of top cover 12 opened in an inclined state with the supporting shaft 14 as a fulcrum. Additionally, the supporting portion 70 of the top cover 12 also moves up. Accordingly, as shown in FIGS. 7, 11A, and 11B, the supporting projection 70*b* of the supporting portion 70 slips off from the inside of the cut recessed portion 72*c* in the holding plate 72 of the state holding device 7, and also slips off from the inside of the recessed portion 64 in the movement supporting frame 61 of the moving device 6.

In the image forming apparatus 1, when the top cover 12 is simply opened, the holding plate 72 of the state holding device 7 is put in a state where the holding plate is pushed in the pushing direction C2 by the stopping member 75 provided at the movement supporting frame 61 which is moving to the mounting completion position P1, and has stopped at the return position (BP) (refer to FIGS. 7 and 11B). For this reason, since the top cover 12 is in the state where the supporting projection 70*b* of the supporting portion 70 is not placed on the holding surface portion 71 of the holding plate 72, if the opened state is not held by the state holding device 7, for example, the moving device 6 does not need to be drawn, it is also possible to hold top cover 12 and release hands to close the cover.

Subsequently, when the front cover 13 is opened by a predetermined angle α, as shown in FIG. 8, the front cover 13 is swung by an angle α in the direction shown by the arrow B1 with the supporting shaft 16 as a fulcrum, and is brought into a half-opened state.

Figure 11B:
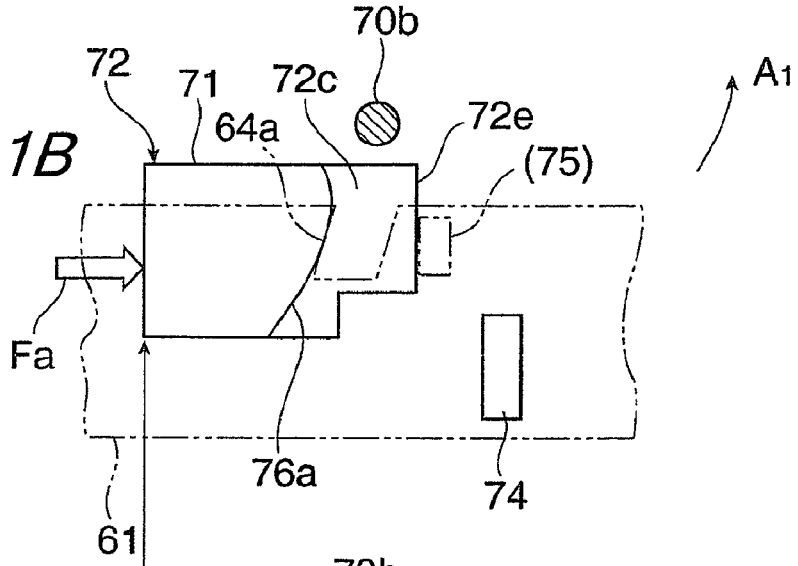
Figure 11C:
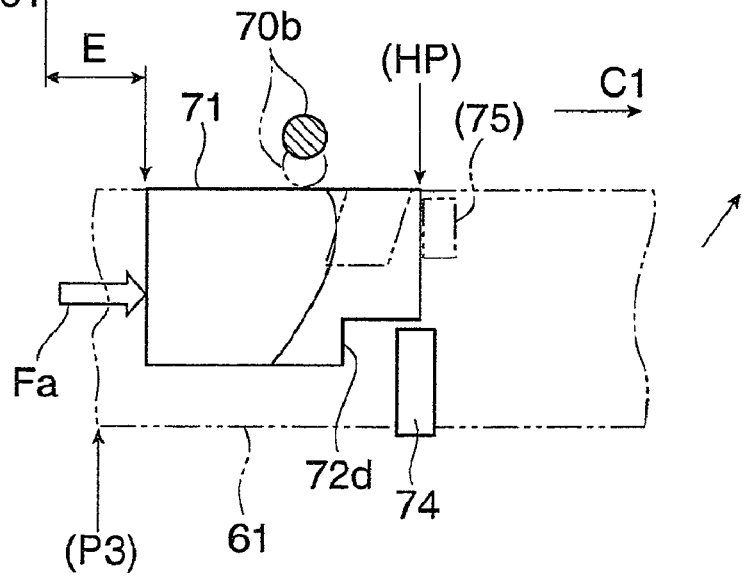

At this time, as shown in FIGS. 8, 11B, and 11C, the movement supporting frame 61 of the moving device 6 moves substantially along the drawing direction C1 from the mounting completion position (P1) to the separation completion position (P3) in conjunction with the operation of opening the front cover 13. That is, the supporting projections 62 and 63 of the movement supporting frame 61 move from lower ends to upper ends in the downwardly inclined guide portions 65*a* and 66*a* of the guide rails 65 and 66.

Accordingly, a mounted component (actually, the photosensitive drum 22) of the imaging device 20 mounted on the movement supporting frame 61 is separated from the intermediate transfer device 30 (actually, the intermediate transfer belt 31). As a result, the operation of moving the movement supporting frame 61 in the drawing direction C1 and the operation of moving the movement supporting frame in the pushing direction C2 become possible. When the movement supporting frame 61 moves to the separation completion position (P3), as shown in FIG. 11C, the frame moves obliquely upward along the inclination angle of the downwardly inclined guide portions 65*a* and 66*a*. At this time, a top face portion of the top face of the movement supporting frame 61 adjacent to the holding plate 72 is set so as not to become higher than the holding surface portion 71 of the holding plate 72.

Figure 9:
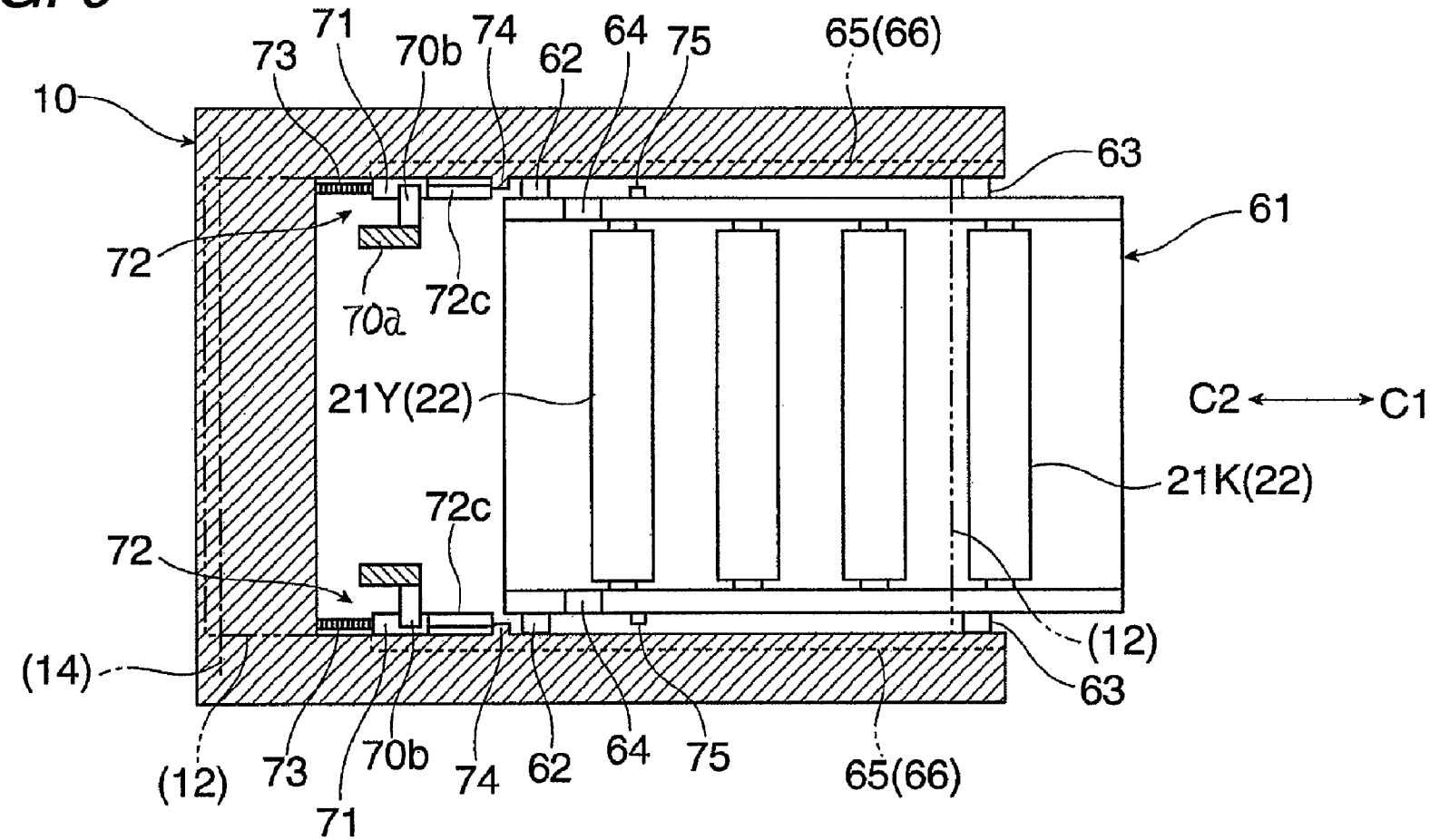
FIG. 9 is a top explanatory view showing an operating state of the state holding device or the like in the image forming apparatus of FIG. 8.

Additionally, when the movement supporting frame 61 of the moving device 6 moves substantially along the drawing direction C1, the holding plate 72 in the state holding device 7 is pushed with a pressing force Fa by the pushing member 73 and is moved by a predetermined distance E in the drawing direction C1, as shown in FIGS. 8, 9, 11C, etc., as the return action by the returning member 75 in the movement supporting frame 61 disappears.

At this time, the distance E by which the holding plate 72 moves is a distance which is required to move to a position (HP) where at least a portion of the holding surface portion 71 is located immediately below the supporting projection 70*b* of the supporting portion 70 in the top cover 12 so that the supporting projection 70*b* can be most early placed thereon. Such a distance E is set by adjusting the opening angle α when being brought into the half-opened state of the front cover 13, the moving distance of the downwardly inclined guide portions 65*a* and 66*a* of the guide rails 65 and 66, etc.

As the holding plate 72 moves to the position (HP) where the supporting projection 70*b* can be most early placed thereon, the supporting projection 70*b* of the supporting portion 70 in the top cover 12 in an opened state as shown in FIG. 8 or 11C is placed on the holding surface portion 71. Accordingly, the state holding device 7 holds the top cover 12 in the specific opened state. At this time, the lowermost portion 24*a* of the LED exposure device 24 on the inner surface side of top cover 12 is held so as to exist at a height position (h1) where a required distance M is secured from the topmost portion 25*a* of a mounted component of an imaging device mounted on the moving holding frame 61. Reference numeral h2 in FIG. 8 designates the height position of the topmost portion 25*a* of the mounted component of the imaging device. The lowermost portion 24*a* of the LED exposure device 24 may be other portions, such as an outer member which exists at the periphery of the light-emitting portion in addition to the light-emitting portion.

In a case where the top cover 12 is held in an opened state by the state holding device 7 in this way, even if a user does not support the top cover 1212, the top cover 12 continues being maintained while being held in a specific opened state when the movement supporting frame 61 of the moving device 6 is moved in the drawing direction C1 or is moved in the pushing direction C2. Thus, the lowermost portion 24*a* of the LED exposure device 24 does not come into contact with the topmost portion 25*a* of a mounted component of the imaging device 20. As a result, the lowermost portion 24*a*, etc. of the LED exposure device 24 is not damaged by the useless contact (collision), etc. with the mounted components of the imaging device 20.

Additionally, the top cover 12 when being held by the state holding device 7 exist in the space S between the document reader 50 and top cover 12, and the opening angle β of top cover 12 (the angle of elevation with respect to the closed state) can be set to a comparatively small angle (for example, a range of 15 to 40°, preferably, 15 to 30'). Since the supporting shaft 14 of the top cover 12 is arranged in a position higher than the fixing device 40 in the image forming apparatus 1, the opening angle β of top cover 12 can be set to a comparatively small angle. When the opening angle β of top cover 12 is set to a small angle, the space which exists between the opened opening and closing cover 12 and the imaging device 20 becomes narrow, and it also becomes difficult for a user to put his/her hand into the space. Thus, there is also no possibility that the LED exposure device 24 may be soiled as a user's hand touches the exposure device.

Subsequently, when the opened state of the top cover 12 by the state holding device 7 is held, the movement supporting frame 61 of the moving device 6 is moved in the drawing direction C1 until the frame reaches the drawing completion position (P2). The front cover 13 is brought into a fully opened state (toppled state) prior to the drawing of the movement supporting frame 61. Accordingly, the moving operation which has made the movement supporting frame 61 pass through a side face opening on the front side of the housing 10 becomes possible.

Figure 10:
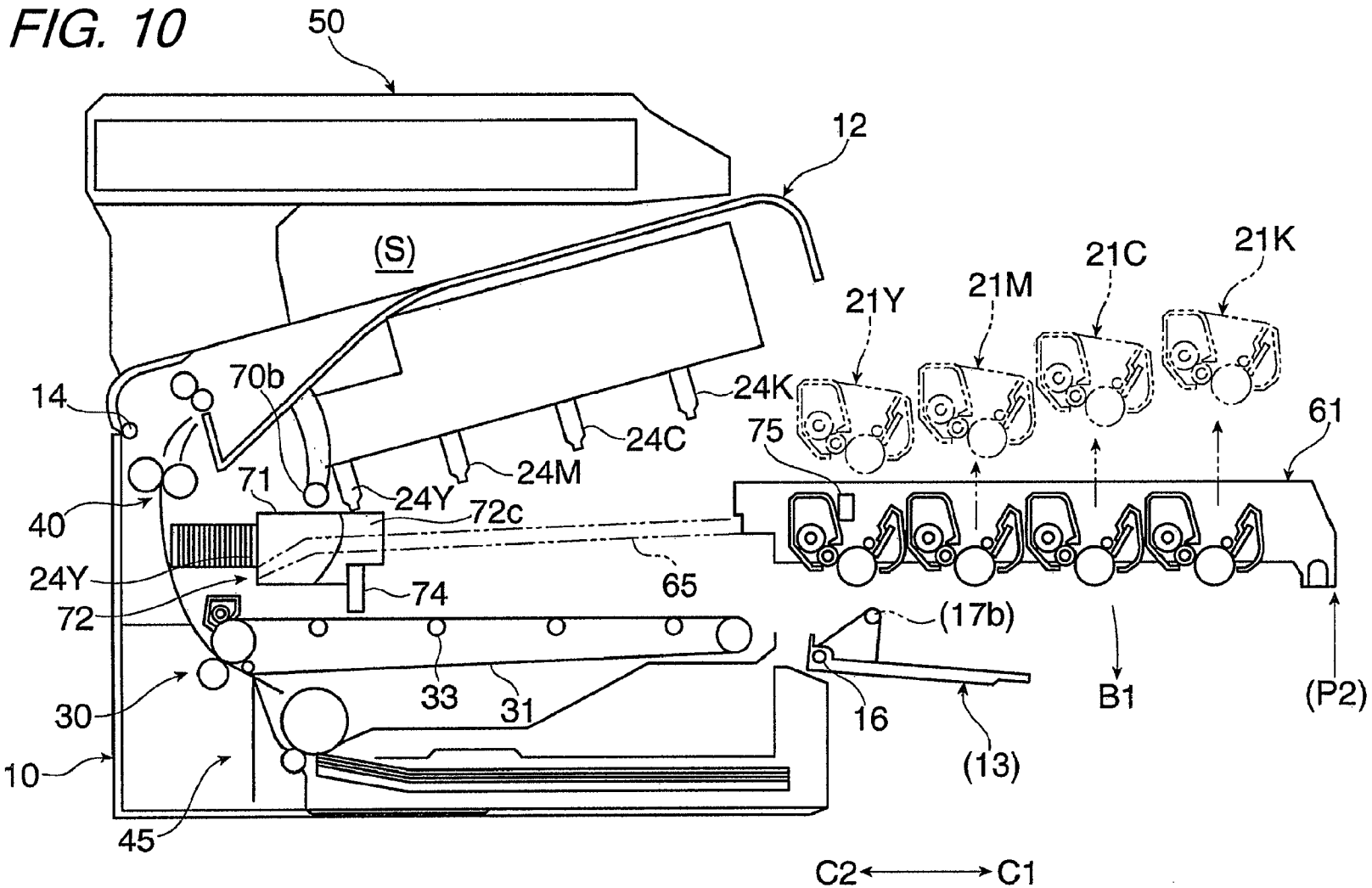
Figure 12A:
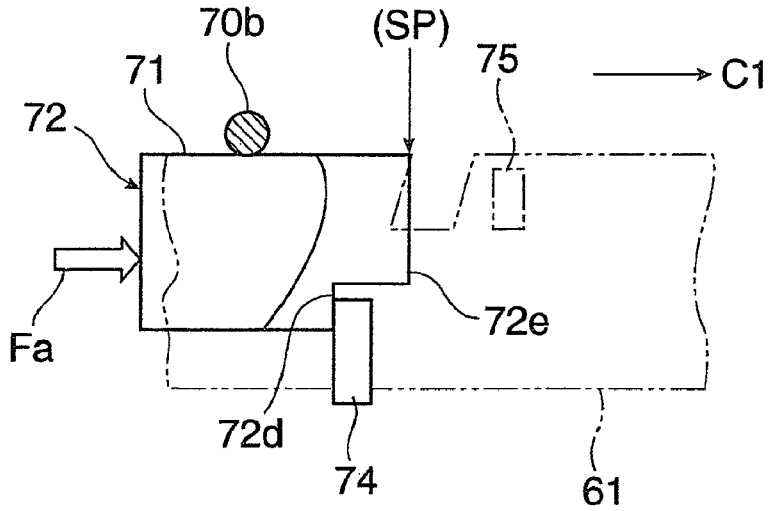

In the image forming apparatus 1, before the movement supporting frame 61 is drawn to the drawing completion position (P2), as shown in FIGS. 9, 10, 12A, etc., the holding plate 72 in the state holding device 7 comes into contact with the stopping member 74 provided in the housing 10, whereby the movement of the holding plate in the drawing direction C1 is stopped. Accordingly, the holding plate 72 exists immediately below the supporting projection 70*b* of the supporting portion 70 of the top cover 12 in a state where at least a portion of the holding surface portion 71 is opened, and is put in a state where the holding plate has stopped at the position (SP) where the supporting projection 71*b* of the supporting portion can be placed on the holding surface portion 71.

Thereafter, when the movement supporting frame 61 moves to the drawing completion position (P2), as shown in FIG. 10, the movement of the movement supporting frame 61 in the drawing direction C1 is stopped by the stopping member of the guide rails 65 and 66.

Accordingly, since the movement supporting frame 61 is exposed to the outside of the housing 10, the mounted components of the imaging device 20 mounted on the movement supporting frame 61 are also be exposed to the outside of the housing 10. In this state, the maintenance operation and replacement operation of the mounted components of the imaging device 20 can be performed.

In the image forming apparatus 1, as shown in FIG. 10, as for the replacement operation of the mounted components, the mounted components can be attached to and detached from the movement supporting frame 61 in units of each imaging unit 21 (except for the LED exposure device 24). At this time, each imaging unit 21 can be configured so as to be attached and detached in a required order, and all the imaging units can also be configured so as to be attached and detached all at once. Additionally, in the image forming apparatus 1, replacement operation, etc. can be performed for at least some of the four imaging units 21 in a state where the movement supporting frame 61 has been drawn to a halfway position before the frame is completely moved to the drawing completion position (P2). Additionally, the movement supporting frame 61 of the moving device 6 can be drawn from the housing 10 (actually, the guide rails 65 and 66), or all the four imaging units 21 can be attached and detached all at once by a drawing operation (refer to FIG. 17, etc.).

Next, as a user pushes and moves the movement supporting frame 61 on which the mounted components have been mounted in the pushing direction C2 with his/her hand after the maintenance operation and replacement operation of the mounted components of the imaging device 20 is ended, the movement supporting frame is mounted inside the housing 10.

When the movement supporting frame 61 is moved in the pushing direction C2, the returning member 75 comes into contact with the holding plate 72 in the state holding device 7 during the movement of the movement supporting frame. Accordingly, the holding plate 72 is pushed and moved in the pushing direction C2 against the pressing force Fa of the pushing member 73 by the returning member 75.

Subsequently, when the movement supporting frame 61 to be pushed arrives at the upper end of the downwardly inclined guide portions 65*a* and 66*a* of the guide rails 55 and 66, and moves to the separation completion position (P3), as shown in FIG. 11B, the holding plate 72 moves to the position (HP) where the supporting projection 70*b* can be most early placed thereon. At this time, since the supporting projection 70*b* of the supporting portion 70 of the top cover 12 is placed on the holding surface portion 71 of the holding plate 72, the top cover 12 is held in a state where the cover is opened by the state holding device 7, and is in a state where the cover cannot be closed.

The movement supporting frame 61 which has moved to the separation completion position (P3), is further pushed in the pushing direction C2, and is moved to the mounting completion position (P1). The pushing operation of the movement supporting frame 61 at this time is performed by performing the operation of closing the front cover 13 serving as a movement operating member. That is, by swinging the front cover 13 in a direction shown by an arrow B2 until the cover is brought into a fully closed state from the half-opened state after the front cover 13 is closed from a fully opened state of to a half-opened state, the movement supporting frame 61 moves in the pushing direction C2 in conjunction with the closing operation.

Figure 12B:
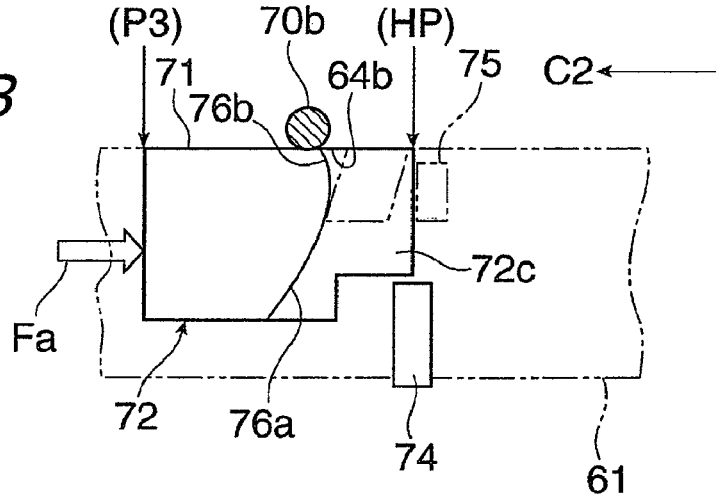
Figure 12C:
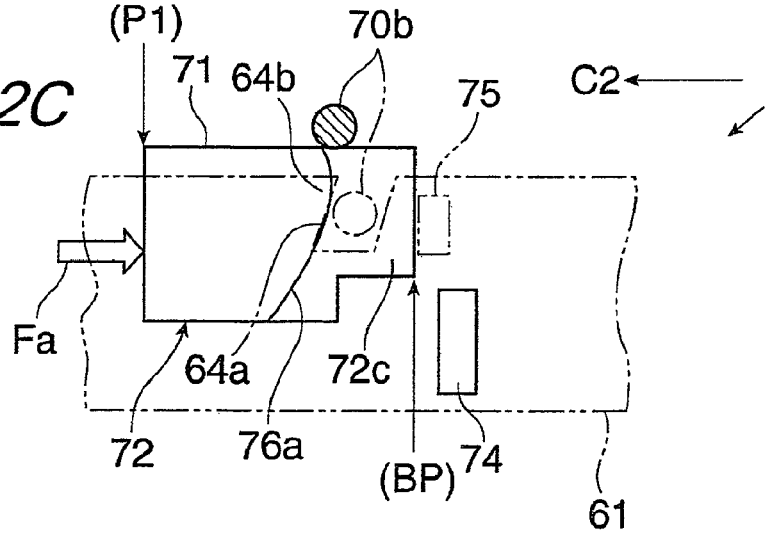

Then, the movement supporting frame 61 moves so that the supporting projections 62 and 63 move obliquely downward along the downwardly inclined guide portions 65*a* and 66*a* of the guide rails 55 and 66, and when the frame finally arrives at the lower end of the guide portion, the frame is brought into a state where the frame has moved to the mounting completion position (21) (refer to FIGS. 7 and 12C). Accordingly, the mounted components of the imaging device 20 mounted on the movement supporting frame 61 are returned to a mounting position where they approach or contact the intermediate transfer device 30 (refer to FIG. 3).

At this time, the holding plate 72 is also pushed by the returning member 75 with the movement of the movement supporting frame 61 in the pushing direction C2, whereby the holding plate, as shown in FIG. 12C, is finally returned to the position (BP) where the holding surface portion 71 does not exist immediately below the supporting projection 70*b* of the supporting portion 70, the cut recessed portion 72*c* exists immediately below the supporting projection 70*b*, and the supporting projection 71*b* of the supporting portion cannot be placed on the holding surface portion 71.

Accordingly, the supporting projection 70*b* of the supporting portion 70 in the top cover 12 is released from the holding by the holding surface portion 71, and is brought into a state where the projection can enter the internal space of the cut recessed portion 72*c*. At this time, since an upper corner 64*b* (refer to FIG. 12B) of the side face portion 64*a* of the recessed portion 64 of the movement supporting frame 61 is brought into a state where the upper corner is hidden (buried) from a state (FIG. 12B) where the upper corner has protruded upward with respect to the inclined connecting face 76*b* in the inclined side face portion 76 of the holding plate 72 (FIG.

12C), the supporting projection 70*b* of the supporting portion (the downward movement of which is not obstructed by the upper corner 64*b*) can be smoothly guided and moved down into the internal space along the cut recessed portion 72*c* along the slope of the inclined connecting face 76*b*.

Figure 3:
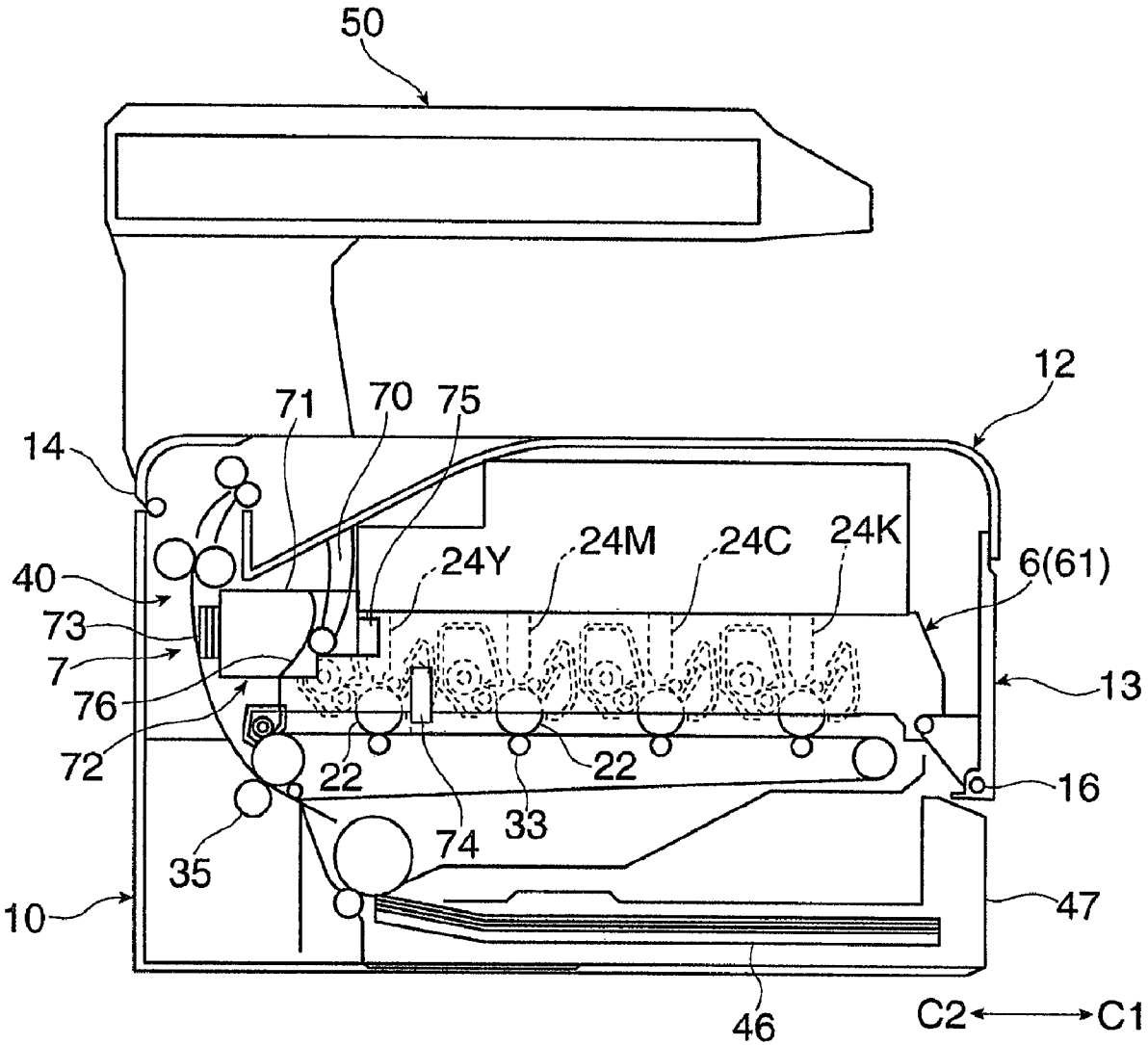
FIG. 3 is an explanatory view showing the configuration of a state holding device in the image forming apparatus of FIG. 1.

As a result, the top cover 12 is swung and closed in the direction shown by the arrow A2 as shown in FIGS. 3, 4, etc. Accordingly, each LED exposure device 24 (Y, M, C, K) attached to the inside of the top cover 12 is returned to the mounting position which faces the photosensitive drum 22 of each imaging unit 21 (Y, M, C, K), which is mounted on the movement supporting frame 61 at the mounting completion position (P1), at a required distance therefrom (refer to FIG. 3).

Additionally, since the top cover 12 can be first closed when the movement supporting frame 61 has moved to the mounting completion position (P1), the top cover 12 is not closed when the movement supporting frame 61 of the moving device 6 or a mounted component of the imaging device 20 mounted thereon exists at a position before being moved to the mounting completion position (P1).

Additionally, when the top cover 12 is closed, as shown in FIG. 12C, the supporting projection 70*b* of the supporting portion 70 moves down and enters the space in the cut recessed portion 72*c* of the holding plate 72, and simultaneously, also moves down to and enters the internal space of the recessed portion 64 of the movement supporting frame 61, and is finally put in a state where the projection can contact the side face portion 64*a* of the recessed portion 64. Accordingly, since the movement of the movement supporting frame 61 in the drawing direction C1 is prevented by the supporting portion 70 (supporting projection 70*b*) of the top cover 12, the movement supporting frame 61 is not drawn when top cover 12 is brought into a closed state (refer to FIG. 3).

In addition, in Embodiment 1, instead of a configuration which the mounted components of the imaging device 20 are returned and positioned to a formal mounting position when the movement supporting frame 61 of the moving device 6 is completely returned to the mounting completion position (P1), when the top cover 12 is closed, the supporting projection 70*b* of the supporting portion 70 may be configured so as to push the side face portion 64*a* against the recessed portion 64 of the movement supporting frame 61 in the pushing direction C2 so that the movement supporting frame 61 is moved until the frame arrives at the mounting position of the mounted components of the imaging device 20. In such a configuration, when the top cover 12 is closed, it is preferable that the movement supporting frame 61 be returned until the lowermost portion 24*a* of the LED exposure device 24 exists at the position where the lowermost portion does not contact the mounted components of the imaging device 20.

FIGS. 13 to 16 show a configuration in a case where the moving device 6 in the above image formation apparatus 1 is provided with the attachment/detachment regulating unit 8 which regulates the attachment and detachment of the mounted components of the imaging device 20.

The attachment/detachment regulating unit 8 holds a shaft 22*a* of the photosensitive drums 22 in each of the four imaging units 21 of the imaging device, which is detachably mounted to the movement supporting frame 61 of the moving device 6, in an undetachable state when the movement supporting frame 61 exists at positions other than the drawing completion position (P2), and releases the holding of the undetachable state when the movement supporting frame 61 moves to and exists at the drawing completion position (P2).

Such an attachment/detachment regulating unit 8 includes a pair of movable regulating plates 81A and 81B which is formed with a regulating groove 82 into which the shaft 22*a* protruding from both ends of the photosensitive drum 22 in each of the four imaging units 21 is fitted, pushing members 83A and 83B, such as coiled springs, which resiliently pushes the movable regulating plates 81A and 81B in the pushing direction C2 by a pressing force Fb on the movement supporting frame 61, and the movable stopping members 84A and 84B which prevents the movement of the movable regulating plates 81A and 81B in the pushing direction C2, and releases the state where the movement is prevented.

Figure 15:
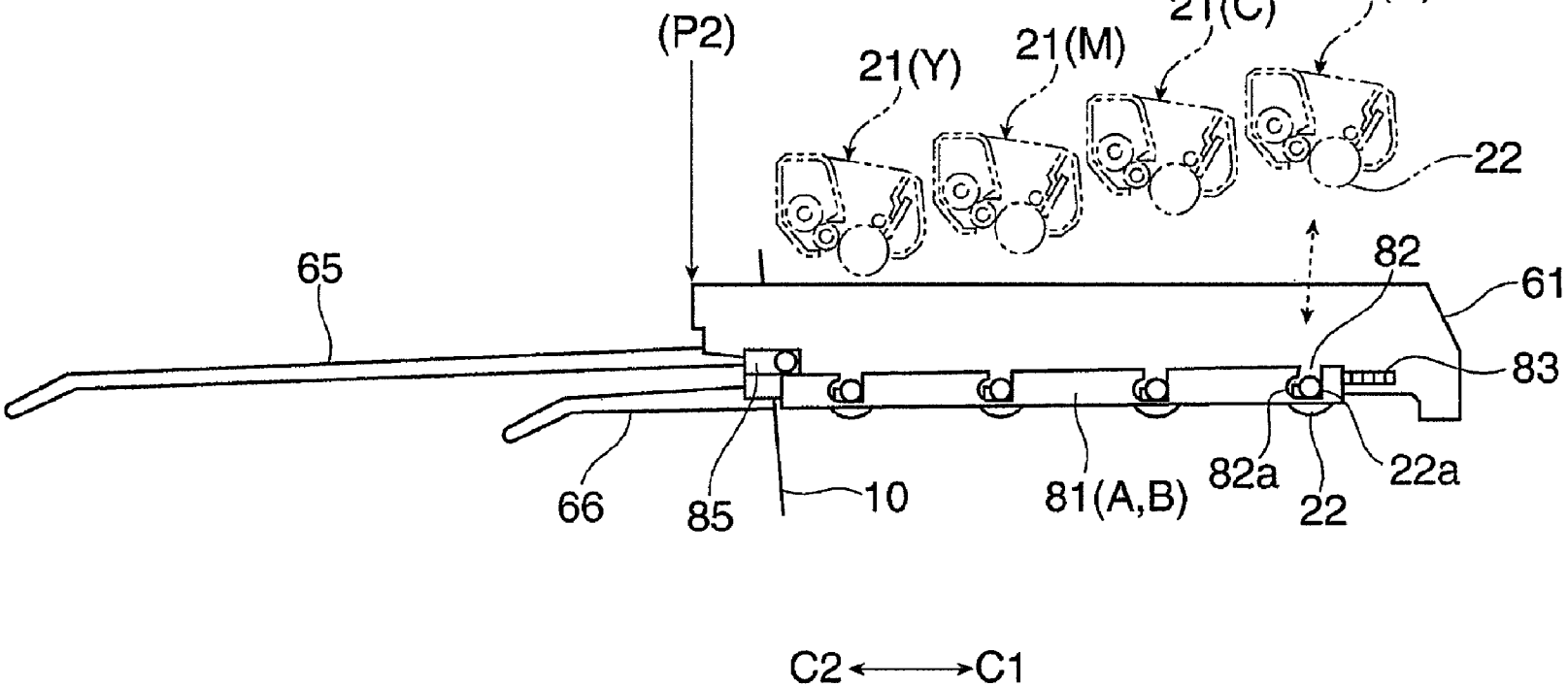
FIG. 15 is an explanatory view showing another operating state (a state when the moving device exists at the pulling-out position) of the attachment/detachment regulating unit of FIG. 13A.

The movable regulating plates 81A and 81B are obtained by forming the regulating groove 82 at a position corresponding to the shaft 22*a* of each of the four photosensitive drums 22 in an elongated plate member. The regulating groove 82, as shown in FIG. 15, etc., is formed in such an L-shape that the shaft 22*a* is put thereinto from above, and a portion (semi-peripheral face portion) thereof is pushed against the recessed portion 82*a* which protrudes in the pushing direction C2 so as to be fitted into the recessed portion in an undetachable state. Additionally, a protruding portion 81*c* which continues contacting the movable stopping member 84 is formed at the upstream end of the movable regulating plate 81A or 81B in the drawing direction C1.

The movable stopping member 84A or 84B includes a movable body 85 attached to the movement supporting frame 61 so as to be able to displace in directions (directions shown by arrows D1 and D2) substantially orthogonal to the drawing direction C1 in a state where the stopping member comes into contact with the protruding portion 81*c* of the movable regulating plate 81A or 81B, and a pushing member 86, such as a coiled spring, which resiliently pushes the movable body 85 toward the inner wall surface of the housing 10. The movable body 85 is formed with an inclined pressing surface 85*a* which is inclined so as to approach the inner wall of the housing 10 toward the downstream in the drawing direction C1 and which continues contacting the protruding portion 81*c*, and a contact raised portion 52*b* which comes into contact with an inner wall portion (contact guide face) of the housing 10 is formed on a side face opposite to the face pushed from the pushing member 83A or 83B.

The inner wall portions (contact guide faces) 10*a* and 10*b* of the housing 10 which come into contact with the contact raised portions 52*b* of the movable bodies 85, respectively, are formed as planar guide face portions which are parallel to each other while the movement supporting frame 61 is within a range from the mounting completion position (P1) to a position ahead of the drawing completion position (P2), and are formed as inclined guide face portions 10*c* and 10*d* which are inclined so as to be opened to the outside of the housing 10 toward the drawing direction C1 within a range from a position ahead of the drawing completion position (P2) to the drawing completion position (P2).

When the contact raised portion 52 of the movable body 85 is on the planar guide face portion 10*a* or 10*b*, the movable body 85 is brought into a state where the movable body is kept at a certain distance from the inner wall surface of the housing 10, and is stopped at a certain position on the movement supporting frame 61. Additionally, when the contact raised portion 52 of the movable body 85 is on the inclined guide face portion 10*c* or 10*d*, the movable body 85 is brought into a state where the movable body is kept, and is displaced in a direction closer to the inner wall surface of the housing 10 on the movement supporting frame 61. The certain position where the movable body 85 is stopped is a position where the movable regulating plate 81A or 81B is pushed in the drawing direction C1 so that a state where the shaft 22*a* of the photosensitive drum 22 is fitted into the recessed portion 82*a* of the regulating groove 82 can be maintained.

Next, the operation of the attachment/detachment regulating unit 8 will be described.

Figure 13A:
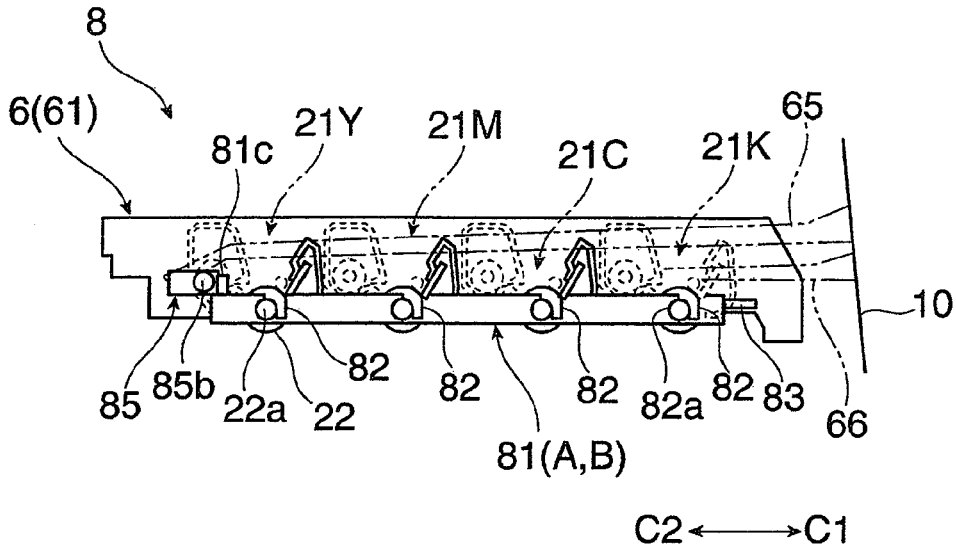
FIGS. 13A and 13B show the configuration of an attachment/detachment regulating unit of a moving device, and specifically.
Figure 13B:
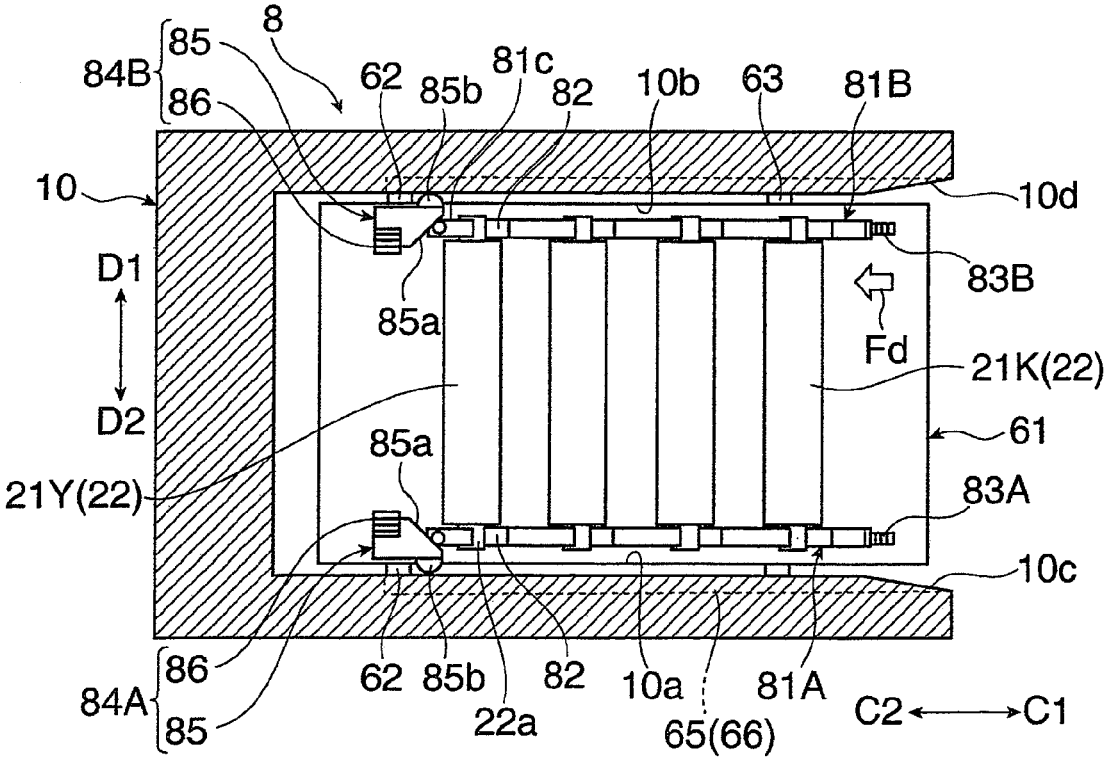

When the movement supporting frame 61 of the moving device 6 exists at a position, such as the mounting completion position (P1), other than the drawing completion position (P2), as shown in FIGS. 13A and 13B, the attachment/detachment regulating unit 8 maintains the shaft 22*a* of the photoconductor drum 22 in each imaging unit 21 among the mounted components mounted on the movement supporting frame 61 in a state where the shaft is inserted into the recessed portion 82*a* of the regulating groove 82 of the movable regulating plate 81A or 81B. That is, since the contact raised portion 52 of the movable body 85 in the movable stopping member 84A or 84B exists in the planar guide face portion 10*a* or 10*b* of the housing 10, the movable regulating plate 81A or 81B is pushed in the drawing direction C1 against the pressing force Fb of the pushing member 83A or 83B by the inclined pressing surface 52*a* of the movable body 85 via the protruding portion 81*c*, and is brought into a state where the shaft 22*a* of the photoconductor drum 22 is fitted into the recessed portion of the regulating groove 82.

Figure 14:
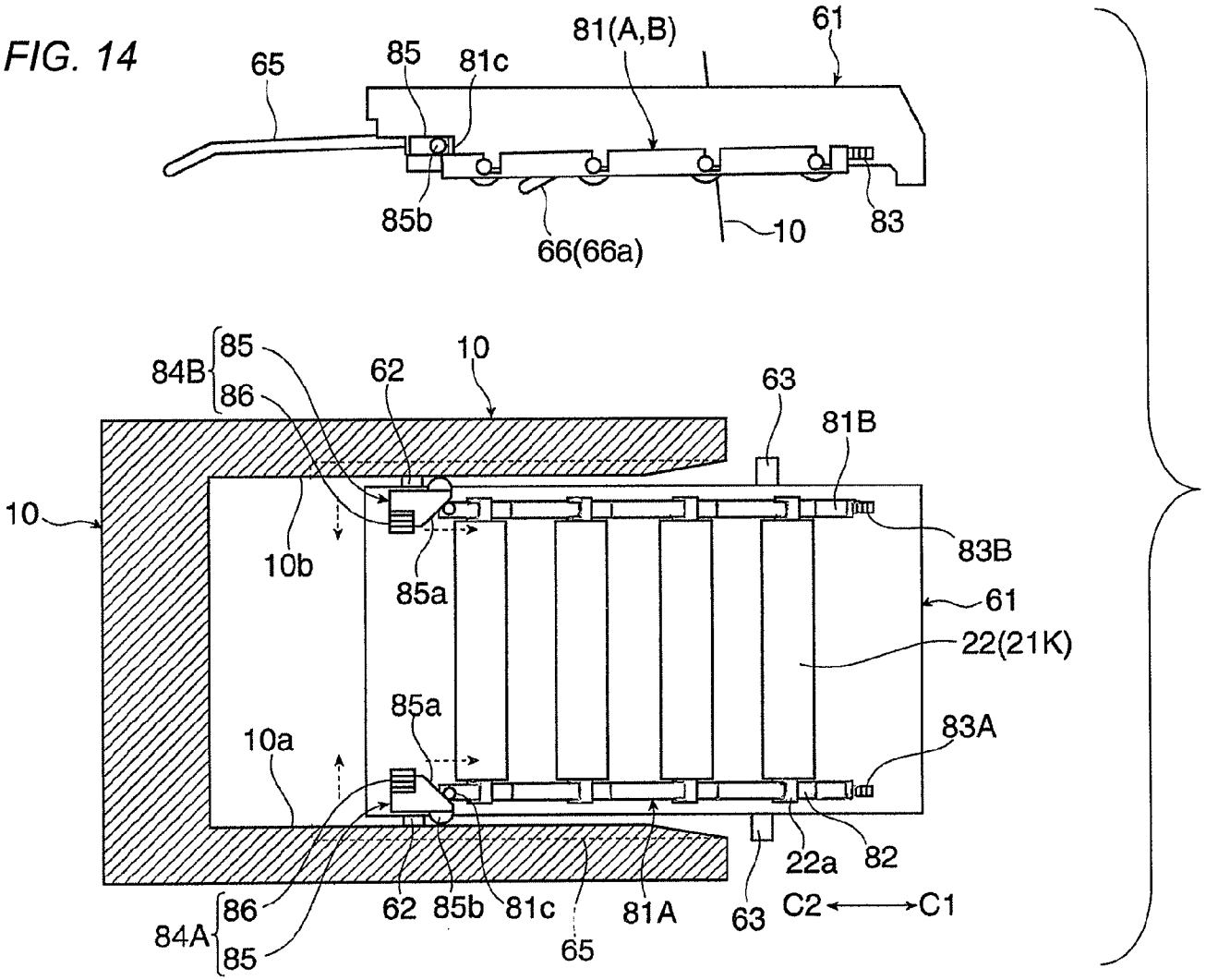
FIG. 14 is an explanatory view showing an operating state (a state when the moving device exists at a position other than a pulling-out position) of the attachment/detachment regulating unit of FIGS. 13A and 13B.

Additionally, the holding state of the attachment/detachment regulating unit 8, as shown in FIG. 14, is also the same in the course of moving the movement supporting frame 61 of the moving device 6 the drawing direction C1 or in the course of moving the movement supporting frame in the pushing direction C2. That is, since the contact raised portion 52 of the movable body 85 exists on the planar guide face portion 10*a* or 10*b* even in the course of the movement of the attachment/detachment regulating unit, the attachment/detachment regulating unit 8 is kept in a state where the movable regulating plate 81A or 81B is pushed in the drawing direction C1 as shown by a dotted-line arrow, and maintains a state where the shaft 22*a* of the photoconductor drum 22 is fitted into the recessed portion of the regulating groove 82.

While the fitting state of the shaft 22*a* of the photoconductor drum 22 by the attachment/detachment regulating unit 8 is held in this way, each imaging unit 21 serving as the mounted components including the photoconductor drum 22 is maintained in a state where the imaging unit cannot be removed from and mounted on the movement supporting frame 61. Accordingly, when the movement supporting frame 61 exists at a halfway position other than the drawing completion position (P2), the attachment/detachment operation of each imaging unit 21 is prevented from being performed.

Figure 16:
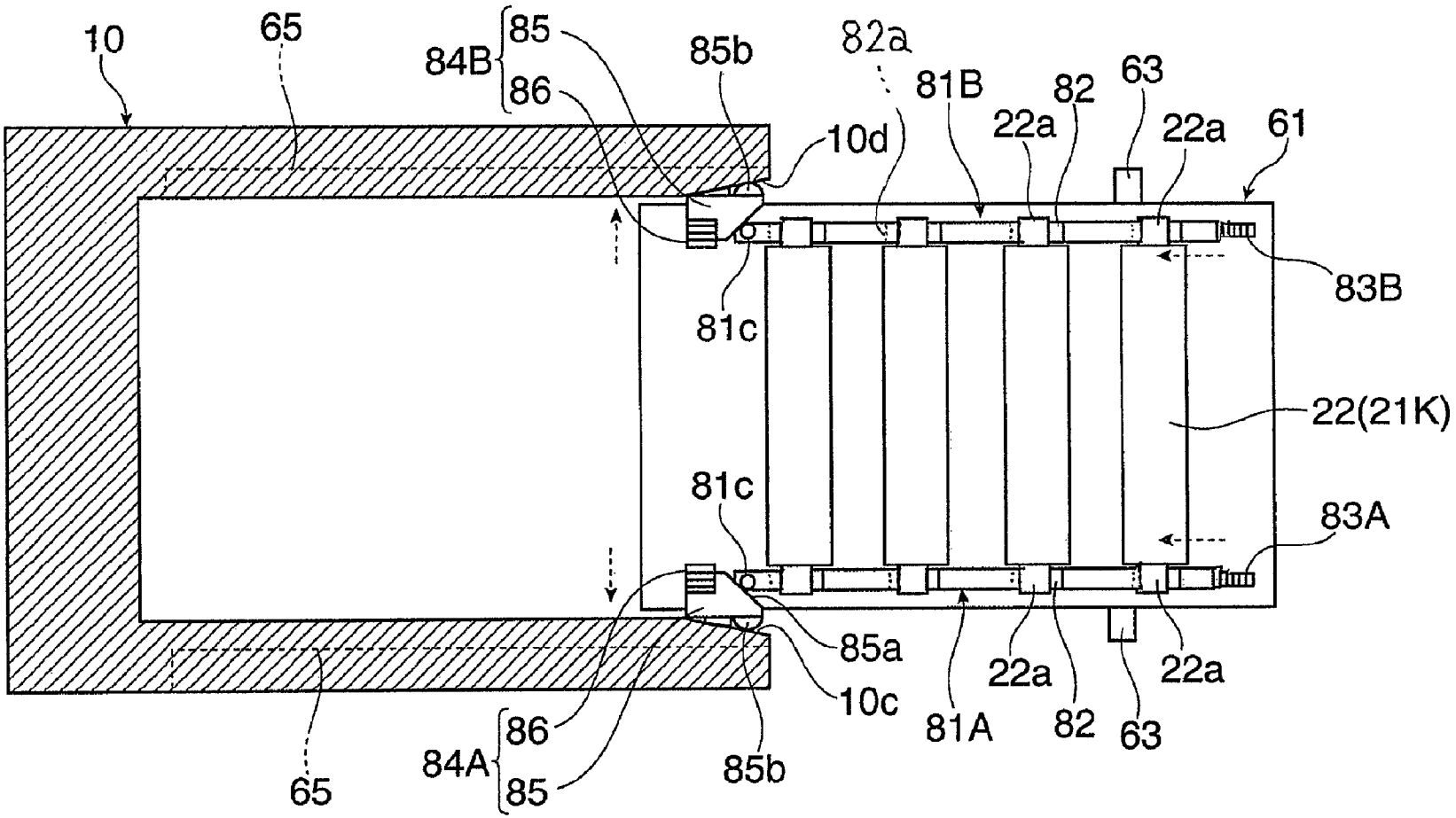
FIG. 16 is an explanatory view showing a state when the operating state of the attachment/detachment regulating unit of FIG. 15 is seen from the top face.

On the other hand, when the movement supporting frame 61 of the moving device 6 moves to and exists at the drawing completion position (P2), as shown in FIGS. 15 and 16, the attachment/detachment regulating unit 8 maintains the shaft 22*a* of the photoconductor drum 22 among the mounted components mounted on the movement supporting frame 61 in a state where the shaft is removed from the recessed portion 82*a* of the regulating groove 82 of the movable regulating plate 81A or 81B.

That is, since the contact raised portion 52 of the movable body 85 in the movable stopping member 84A or 84B exists in the inclined guide face portion 10*c* or 10*d* of the housing, the movable body 85 is displaced in a direction closer to the inner wall surface as shown by a dotted-line arrow (a direction which moves outward), and since the inclined pressing surface 85*a* of the movable body 85 with which the protruding portion 81*c* of the movable regulating plate 81A or 81B comes into contact is also retreated, the movable regulating plate 81A or 81B is pushed by the pressing force Fb of the pushing member 83, and is moved in the pushing direction C2 on the movement supporting frame 61 as shown by a dotted-line arrow. As a result, the movable regulating plate 81A or 81B brought into a state where the shaft 22*a* of the photoconductor drum 22 is opened from the recessed portion 82*a* of the regulating groove 82.

Accordingly, since the attachment and detachment of the shaft 22*a* of the photoconductor drum 22 to/from the regulating groove 82 become free, each imaging unit 21 serving as the mounted components including the photoconductor drum 22, as shown in FIG. 15, can be removed from or mounted to the movement supporting frame 61. In addition, when the movement supporting frame 61 is pushed in the pushing direction C2 so as to be mounted, the contact raised portion 52 of the movable body 85 in the movable stopping member 84A or 84B exists in the planar guide face portion 10*a* or 10*b* from the inclined guide face portion 10*c* or 10*d*. Thus, the movable regulating plates 81A and 81B is held in a state where the shaft 2*a* of the photosensitive drum 22 is fitted into the recessed portion 82*a* of the regulating groove, and cannot be attached and detached (refer to FIG. 14).

Figure 17:
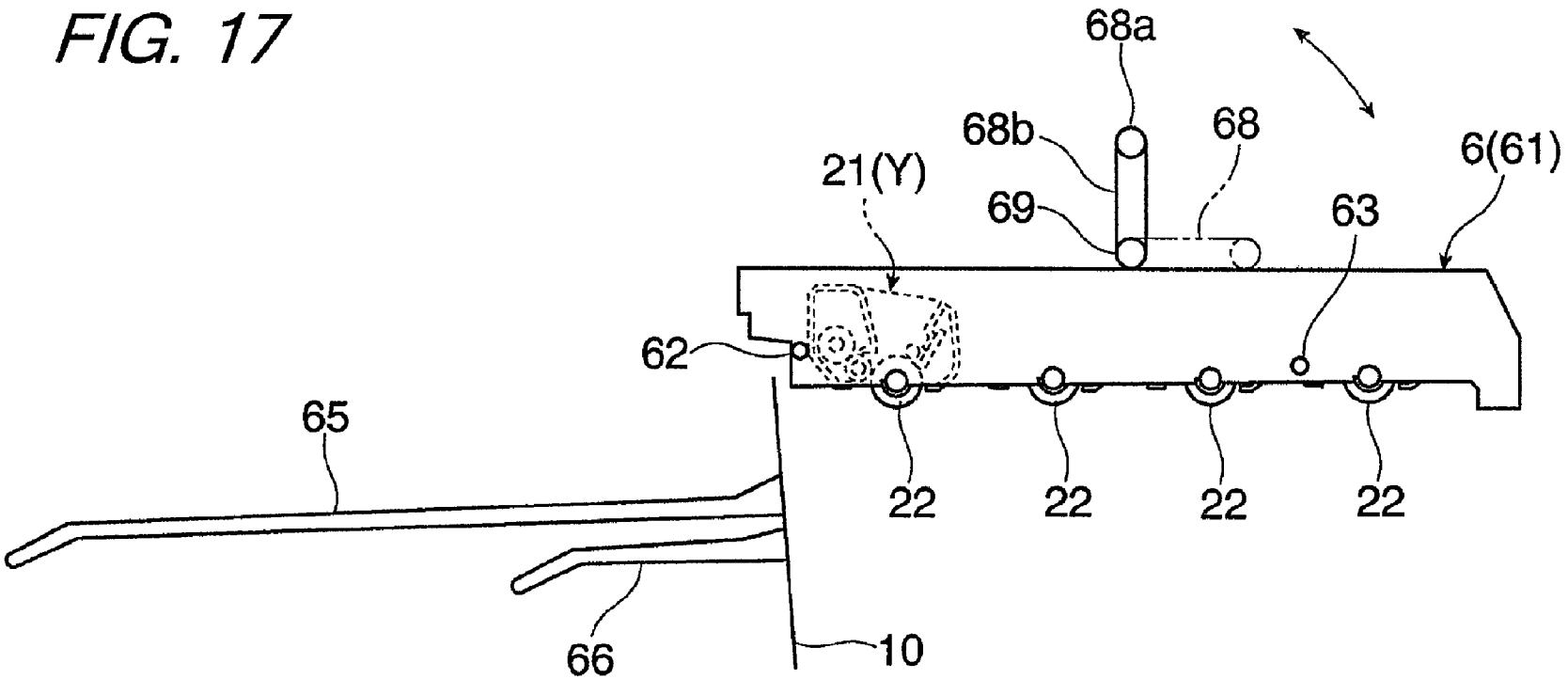
FIG. 17 is an explanatory view showing a configuration example which the moving device is provided with a handle.

FIG. 17 shows a configuration example in which the movement supporting frame 61 of the moving device 6 in the image forming apparatus 1 is provided with a handle 68.

The handle 68 is provided substantially at the central portion of the movement supporting frame 61, and for example, a handle provided with a grasping portion 68*a* and a supporting portion 68*b* is applied. The handle 68 is formed as a so-called retractable handle which is erected when being used, and is toppled when being not used. In this configuration example, a structure which is swung in the direction of an arrow with the supporting shaft 69 as a fulcrum at the lower end of the supporting portion 68*b* is adopted as the retractable handle 68.

Such a handle 68 is brought into a toppled state when the handle 68 is in a state where the movement supporting frame 61 is mounted inside the housing 10. Accordingly, the handle 68 can be brought into a state where the handle does not become a hindrance to the movement of the movement supporting frame 61, the operation of the imaging device 20, etc.

Additionally, when the movement supporting frame 61 is moved in the drawing direction C1, and drawn to the drawing completion position (P2), the handle 68 is brought into an erected state, whereby a user lifts up the handle 68 by his/her hand as shown in FIG. 17 so that the whole movement supporting frame 61 can be detached from (the guide rails 65 and 66 of) the housing 10. In this case, it is possible to detach the mounted components of a plurality of imaging units mounted on the movement supporting frame 61 from the movement supporting frame 61 at a time, or to attach the mounted components to the movement supporting frame 61. As a result, it is possible to efficiently perform the checking operation and replacement operation of the mounted components.

[Other Embodiments]

Figure 18:
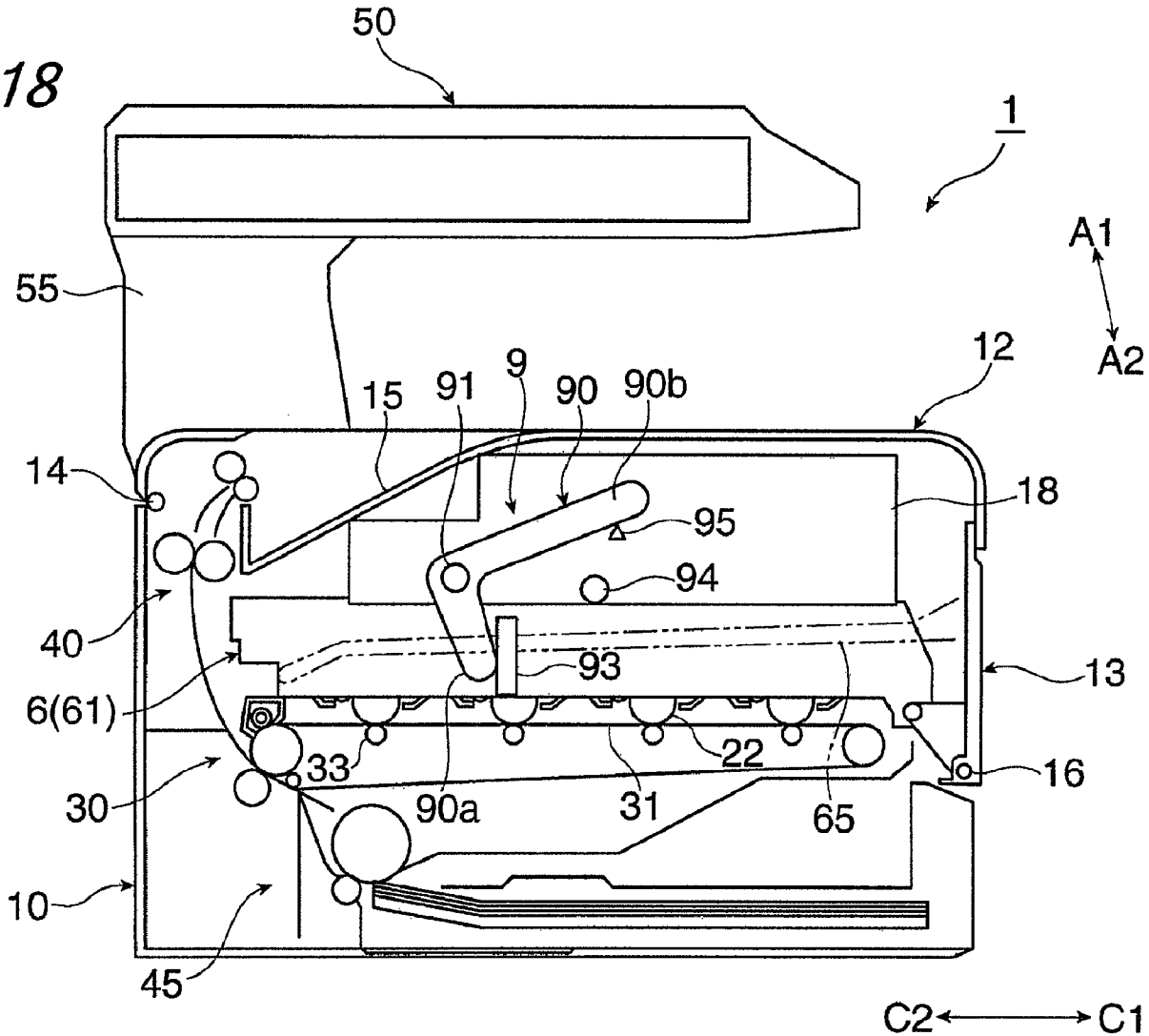
FIG. 18 is an explanatory view showing a configuration example of the image forming apparatus provided with an interlocking device.
Figure 19:
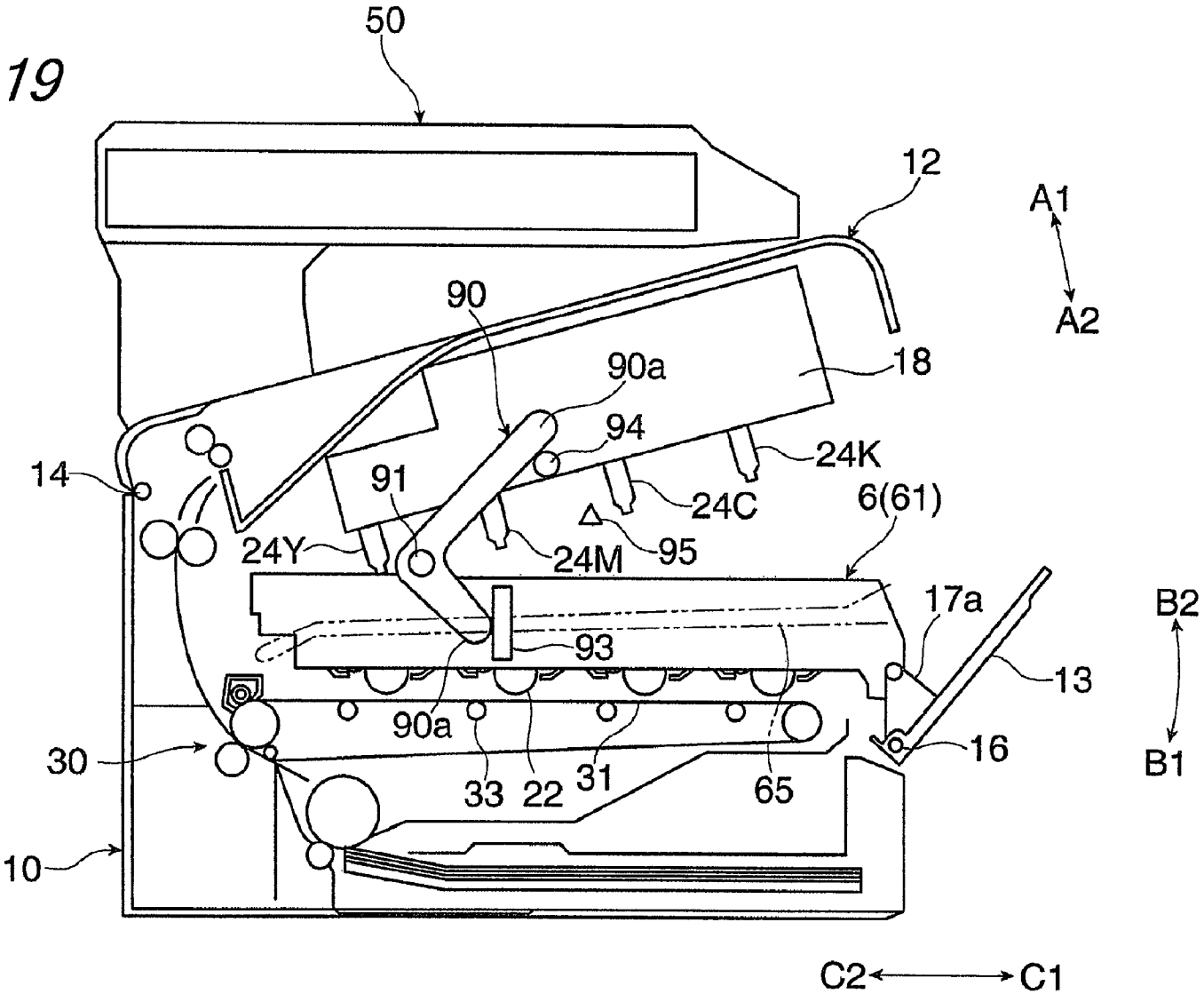
FIG. 19 is an explanatory view showing an operating state of the interlocking device of FIG. 18.

FIGS. 18 and 19 show a configuration example in which an interlocking device 9 which moves the movement supporting frame 61 of the moving device 6 by a required distance in the drawing direction C1 from the mounting completion position (P1) with the operation of opening the top cover 12 when the cover is opened is provided in the image forming apparatus 1 according to an exemplary embodiment 1.

The interlocking device 9 mainly includes an L-shaped a swinging plate 90 having a long side portion 90*a* and a short side portion 90*b* and attached to the housing 10 so as to be swingable with the supporting shaft 91 as a fulcrum, a contact plate 93 provided at the position in the side face portion of the movement supporting frame 61 where a portion of the short side portion 90*b* of the swinging plate 90 can contact, and a protruding portion 94 provided at the position of a portion (structure 18) in the inner surface of the top cover 12 where the lower end of the long side portion 90*a* of the swinging plate 90 can contact.

The swinging plate 90 has such a shape that the long side portion 90*a* and the short side portion 90*b* intersect each other substantially at a right angle. The supporting shaft 91 is installed, for example, at an upper position of the movement supporting frame 61, and at the position closer to the supporting shaft 14 than the central portion of the top cover 12. The protruding portion 94 is arranged at the position almost flush with the supporting shaft 91. Additionally, the housing 10 is provided with a supporting projection 95 which supports the long side portion 90*a* of the swinging plate 90 so as to be stopped at the position apart by a required distance from the protruding portion 94 when the top cover 12 is closed. On the other hand, when the long side portion 90*a* of the swinging plate 90 is supported by the supporting projection 95, the short side portion 90*b* of the swinging plate 90 is set so as to be maintained in a state where the short side portion comes into contact with the contact plate 93 of the movement supporting frame 61. This is provided to prevent the unnecessary contact between the lowermost portion 24*a* of the LED exposure device 24, and the mounted components of the imaging device 20 such that the movement supporting frame 61 is moved in the drawing direction C1 after top cover 12 is opened to a certain angle (an angle less than the opening angle β).

In the image forming apparatus 1 provided with the interlocking device 9, as shown in FIG. 19, after top cover 12 is opened by a required angle and the protruding portion 94 has contacted the long side portion 90*a* of the swinging plate 90 when the top cover 12 is opened, the swinging plate 90 also swings in the direction shown by the arrow A1 with the supporting shaft 91 as a fulcrum in conjunction with the operation of swinging in the direction shown by the arrow A1 with the supporting shaft 14 of top cover 12 as a fulcrum. Accordingly, since the short side portion 90*b* of the swinging plate 90 which swings is displaced while contacting the contact plate 93 of the movement supporting frame 61, the force which pushes the movement supporting frame 61 in the drawing direction C1 is generated. As a result, the swinging plate 90 moves the movement supporting frame 61 in the drawing direction C1.

Since the image forming apparatus 1 has a structure where the movement supporting frame 61 is connected with the front cover 13 as mentioned above, when the movement supporting frame 61 is moved in the drawing direction C1, the front cover 13 is brought into an opened state according to the travel distance of the frame. As the required distance by which the movement supporting frame 61 is moved in the drawing direction C1 by the interlocking device 9, for example, as mentioned above, it is preferable that the movement supporting frame 61 is moved by such a distance that the frame arrives at the separation completion position (P3: refer to FIGS. 8 and 11C). When this setting is performed, the state holding device 7 may be configured so as to shift automatically to the state where the front cover 13 is held in the specific opened state.

When the top cover 12 is opened in this way, since the movement supporting frame 61 is moved in the drawing direction C1 by a required distance by the interlocking device 9, the operation which a user draws the movement supporting frame 61 can be promoted. Additionally, when the required distance by which the movement supporting frame 61 is moved in the drawing direction C1 by the interlocking device 9 is set to a travel distance which is enough until the movement supporting frame arrives at the separation completion position (P3), top cover 12 can be begun to be held in a specific opened state by the state holding device 7 simultaneously when the top cover 12 is opened. Incidentally, in a case where the image forming apparatus has the structure where the movement supporting frame 61 is connected with the front cover 13, when the operation of closing the front cover 13 is performed, it is possible to close the top cover 12 in conjunction with the closing operation of the front cover 13 by the interlocking device 9.

Figure 20:
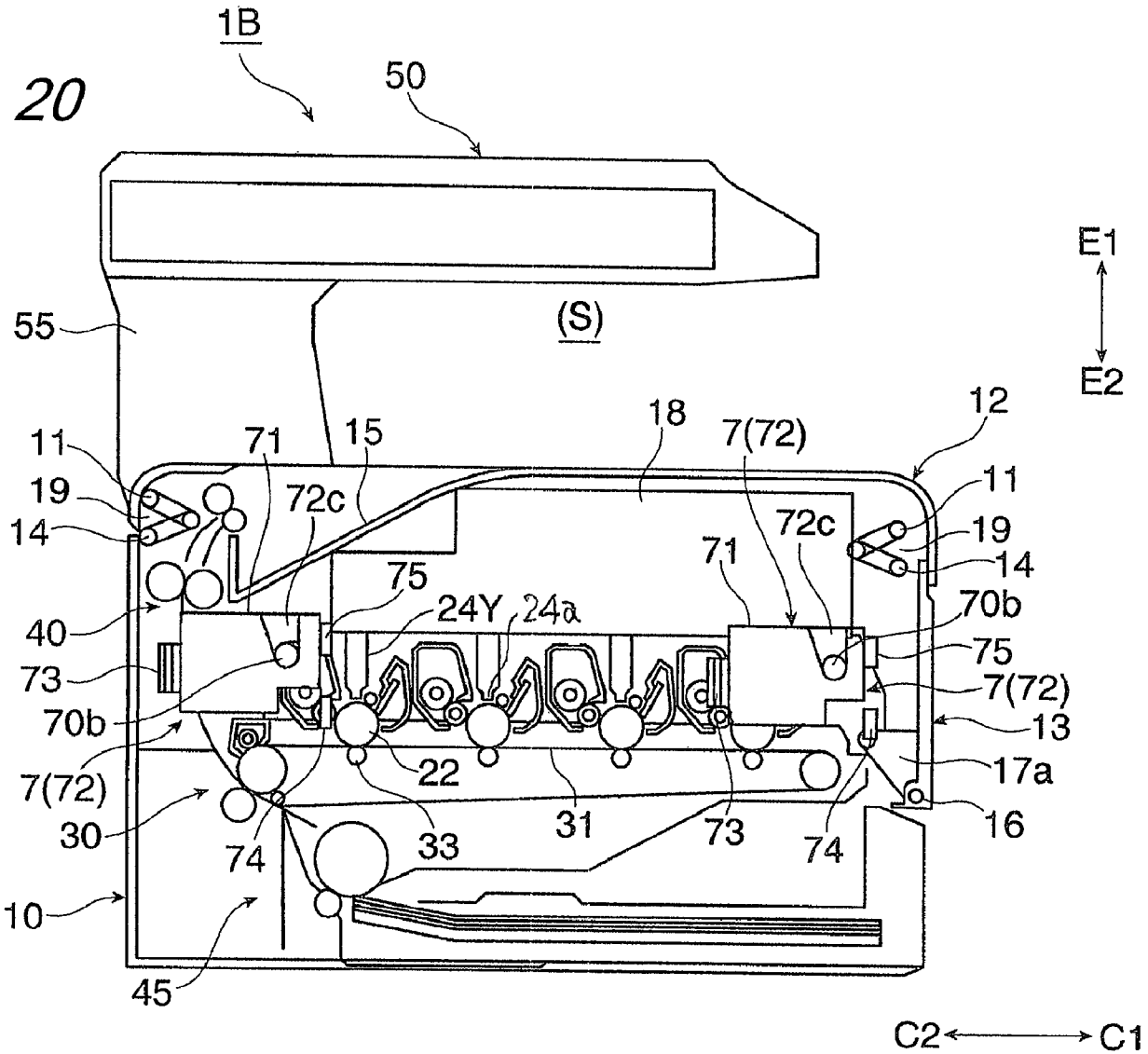
FIG. 20 is an explanatory view showing a configuration example of the image forming apparatus in which the top cover adopts a different opening and closing method.
Figure 22:
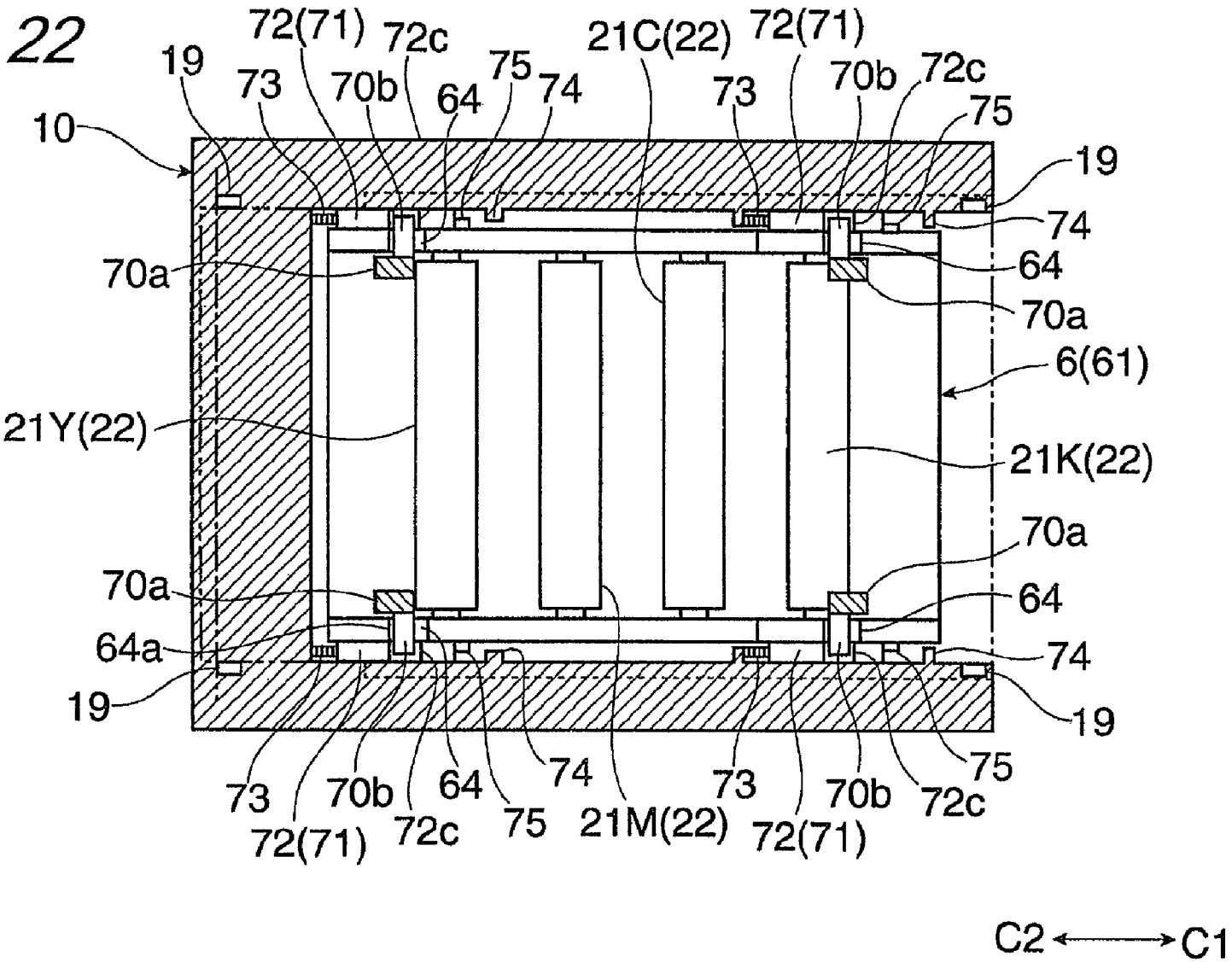
FIG. 22 is an explanatory view shown a state when the configurations of the top cover, the state holding device, etc. in the image forming apparatus of FIG. 20 are seen from the top face.

FIG. 22 shows a configuration example in which a portion of the image forming apparatus from FIG. 20 is modified.

The image forming apparatus 1B is an apparatus in which the above image forming apparatus is modified to a structure in which the top cover 12 is moved in the vertical direction of the housing 10 and is opened and closed, and a portion of the state holding device 7 is modified with the modification. Configurations other than this are the same as those of the image forming apparatus 1 according to an exemplary embodiment 1.

The top cover 12 is attached so as to move up and down (ascend and descend) toward a gap S between the cover and the document reader 50 in the top face opening of the housing 10. In this configuration example, a structure is adopted in which a bent supporting member 19 including two supporting pieces 19*a* and 19*b* which are coupled together about a coupling shaft 19*c* is installed at each of four corners of the top cover 12, and the supporting pieces 19*a* and 19*b* in the bent supporting member 19 are distributed and rotatably attached to the supporting shaft 14 on the side of the housing 10 and the supporting shaft 11 on the side of top cover 12. A load is applied to the supporting pieces 19*a* and 19*b* in a direction which is bent by a helical spring (not shown) at the coupling shaft 19*c*. Additionally, a fixing portion (not shown) which is fixed in a certain posture so as to keep the supporting pieces from rotating about the coupling shaft 19*c* when the supporting pieces are extended and deployed from the bent state is formed.

From the relationship where the state holding device 7 adopts a structure in which the top cover 12 is supported via the four bent supporting members 19 at the time of opening and closing, the inner surface portion of top cover 12 is provided with four supporting portions 70, and four holding plates 72 in which a holding surface portion 71 which holds (supporting projection 70*b* of) the four supporting portions 70 is formed is arranged. All the four supporting portions 70 are constituted by the supporting arm 70*a* and the supporting projection 70*b* similarly to the two supporting portions 70 in Embodiment 1. Similarly to the two holding plates 72 in Embodiment 1, the four holding plates 72 are attached to the housing 10 in a state where they can move along the drawing direction C2, and form a cut recessed portion 72*a*. Additionally, similarly to the state holding device 7 in Embodiment 1, in the state holding device 7, the pushing member 73, the stopping member 74 and the returning member 75 are provided so as to correspond to each supporter 72. The recessed portion 64 which has the side face portion 64*a* is provided in the movement supporting frame 61 similarly to the case in Embodiment 1.

Next, the operation when the maintenance operation and replacement operation of (mounted components of) the imaging device 20 in the image forming apparatus 1B are performed will be described. When the maintenance operation and replacement operation is performed, the operation of drawing the moving device 6 is performed after the top cover 12 is opened, and the front cover 13 is then opened.

Figure 21:
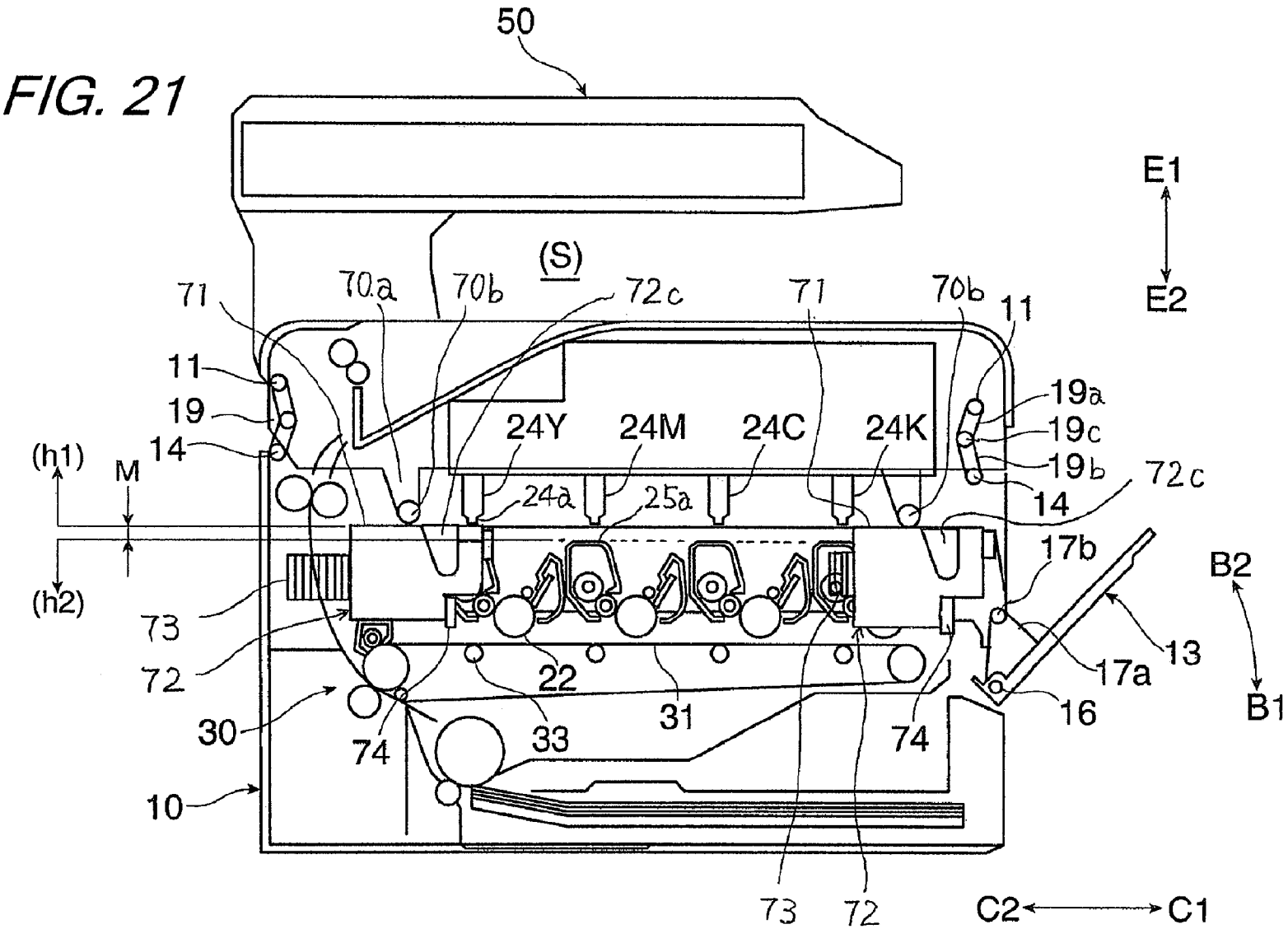
FIG. 21 is an explanatory view showing the operating state of the top cover and the operating state of state holding device when the top cover is opened and the front cover is opened to a half-opened state, in the image forming apparatus of FIG. 20.

First, when the top cover 12 is opened in a state where the cover is lifted as shown by an arrow E1 with a user's hand, top cover 12, as shown in FIG. 21, moves up so as to move in parallel as the bent supporting member 19 is stretched and extended from a bent state, and is moved into the space S formed between top cover 12 and the document reader 50.

At this time, the four LED exposure devices 24 (Y, M, C, K) attached to the inside of the top cover 12 move upward substantially in parallel along with top cover 12, and are separated from the imaging units 21 (Y, M, C, K), respectively. The four LED exposure device 24 (Y, M, C, K) at this time are put in a state where the exposure devices are arranged substantially in a horizontal direction in correspondence with the opened state of top cover 12. Additionally, the supporting portion 70 of the top cover 12 also moves up. Accordingly, the supporting projection 70*b* of the supporting portion 70 slips off from the inside of the cut recessed portion 72*c* in the holding plate 72 of the state holding device 7, and also slips off from the inside of the recessed portion 64 in the movement supporting frame 61 of the moving device 6.

Subsequently, when the front cover 13 is opened by a predetermined angle α, as shown in FIG. 21, the front cover 13 is swung by an angle α in the direction shown by the arrow B1 with the supporting shaft 16 as a fulcrum, and is brought into a half-opened state.

At this time, the movement supporting frame 61 of the moving device 6 moves substantially along the drawing direction C1 from the mounting completion position (P1) to the separation completion position (P3) in conjunction with the operation of opening the front cover 13 (refer to FIGS. 11B and 11C). Accordingly, a mounted component (actually, the photosensitive drum 22) of the imaging device 20 mounted on the movement supporting frame 61 is separated from the intermediate transfer device 30 (actually, the intermediate transfer belt 31). As a result, the operation of moving the movement supporting frame 61 in the drawing direction C1 and the operation of the movement supporting frame in the pushing direction C2 become possible.

Additionally, when the movement supporting frame 61 moves to the separation completion position (P3), as shown in FIG. 21, the frame moves obliquely upward along the inclination angle of the downwardly inclined guide portions 65*a* and 66*a*. Additionally, when the movement supporting frame 61 of the moving device 6 moves substantially along the drawing direction C1, the holding plate 72 in the state holding device 7 is pushed with a pressing force Fa by the pushing member 73 and is moved by a predetermined distance E in the drawing direction C1 as the return action by the returning member 75 in the movement supporting frame 61 disappears (refer to FIG. 11C).

As the holding plate 72 moves to the position (HP) where the supporting projection 70*b* can be most early placed thereon, the supporting projection 70*b* of the supporting portion 70 in the top cover 12 in an opened state as shown in FIG. 21 is placed on the holding surface portion 71. Accordingly, the state holding device 7 holds the top cover 12 in a specific opened state. At this time, all the lowermost portion 24*a* of the LED four exposure devices 24 (Y, M, C, K) on the inner surface side of top cover 12 is held so as to exist at a height position (h1) where a required distance M is secured from the topmost portion 25*a* of a mounted component of an imaging device mounted on the moving holding frame 61. Reference numeral h2 in FIG. 21 designates the height position of each topmost portion 25*a* of the mounted component of the imaging device.

In a case where the top cover 12 is held in an opened state by the state holding device 7 in this way, even if a user does not support the top cover 12 with his/her hand, when the movement supporting frame 61 of the moving device 6 is moved in the drawing direction C1 or is moved in the pushing direction C2, the lowermost portion 24*a* of the LED exposure device 24 does not come into contact with the topmost portion 25*a* of a mounted component of the imaging device.

Additionally, at this time, the top cover 12 when being held by the state holding device 7 exist in the space S between the document reader 50 and top cover 12, and the space which exists between the opened opening and closing cover 12 and the imaging device 20 becomes extremely narrow. For this reason, since it also becomes difficult for a use to put his/her hand into the space, there is no possibility that the LED exposure device 24 may be soiled as a user's hand touches the exposure device.

Subsequently, when the opened state of the top cover 12 by the state holding device 7 is held, the movement supporting frame 61 of the moving device 6 is moved in the drawing direction C1 until the frame reaches the drawing completion position (P2). The front cover 13 is brought into a fully opened state (toppled state) prior to the drawing of the movement supporting frame 61.

On the other hand, in the image forming apparatus 1B, when the movement supporting frame 61 which has moved to the separation completion position (P3) is further pushed in the pushing direction C2 and is moved to the mounting completion position (P1), the operation of closing the front cover 13 serving as a movement operating member is performed similarly to Embodiment 1. That is, by swinging the front cover 13 in the direction shown by the arrow B2 until the cover is brought into a fully closed state from the half-opened state after the front cover 13 is closed from a fully opened state of to a half-opened state, the movement supporting frame 61 moves in the pushing direction C2 in conjunction with the closing operation.

Then, the movement supporting frame 61 moves so that the supporting projections 62 and 63 move obliquely downward along the downwardly inclined guide portions 65*a* and 66*a* of the guide rails 55 and 66, and when the frame finally arrives at the lower end of the guide portion, the frame is brought into a state where the frame has moved to the mounting completion position (P1) (refer to FIGS. 7 and 12C). Accordingly, the mounted components of the imaging device 20 mounted on the movement supporting frame 61 are returned to a mounting position where they approach or contact the intermediate transfer device 30.

At this time, the four holding plates 72 are also pushed to the returning members 75 with the movement of the movement supporting frame 61 in the pushing direction C2, whereby the holding plates, are finally returned to the position (BP) where the holding surface portion 71 does not exist immediately below the supporting projection 70*b* of the supporting portion 70, the cut recessed portion 72*c* exists immediately below the supporting projection 70*b*, and the supporting projection 71*b* of the supporting portion cannot be placed on the holding surface portion 71.

Accordingly, the supporting projection 70*b* of the supporting portion 70 in the top cover 12 is released from the holding by the holding surface portion 71, and is brought into a state where the projection can enter the internal space of the cut recessed portion 72*c*. As a result, the top cover 12 is moved down and closed in a state where the cover moves in parallel in the direction shown by the arrow E2 as shown in FIGS. 20 and 22. Accordingly, each LED exposure device 24 (Y, M, C, K) attached to the inside of the top cover 12 is returned to the mounting position which faces the photosensitive drum 22 of each imaging unit 21 (Y, M, C, K) which is mounted on the movement supporting frame 61 at the mounting completion position (P1) (refer to FIG. 20).

Additionally, even in the image forming apparatus 1B, since the top cover 12 can be first closed when the movement supporting frame 61 has moved to the mounting completion position (P1), the top cover 12 is not closed before the movement supporting frame 61 of the moving device 6 or a mounted component of the imaging device 20 mounted thereon is returned to and positioned at a formal mounting position.

Additionally, when the top cover 12 is closed, as shown in FIG. 22, the supporting projection 70*b* of the supporting portion 70 moves down and enters the space in the cut recessed portion 72*c* of the holding plate 72, and simultaneously, also moves down to and enters the internal space of the recessed portion 64 of the movement supporting frame 61, and is finally put in a state where the projection can contact the side face portion 64*a* of the recessed portion 64. Accordingly, since the movement of the movement supporting frame 61 in the drawing direction C1 is prevented by the supporting portion 70 (supporting projection 70*b*) of the top cover 12, the movement supporting frame 61 is not drawn when top cover 12 is brought into a closed state (refer to FIG. 22).

In addition, the image forming apparatus to which the invention is applied may be an apparatus in which the document reader 50 is not installed. The exposure device attached to the inner surface side of the top cover 12 is not limited to an LED exposure device configured using an LED, and may be other types of exposure devices configured using light sources other than the LED. Additionally, the number or kind (those used as mounted components) of imaging devices 20 (imaging units 21) mounted on (the movement supporting frame 61 of) the moving device 6 is not particularly limited, and an image forming apparatus may adopt a type (a so-called direct transfer type) which does not use the intermediate transfer device 30.

In addition, the front cover 13 may not have the structure in which the cover is connected with the movement supporting frame 61 of the moving device 6. In this case, for example, a movement operating lever which moves the movement supporting frame 61 of the moving device 6 to a position where the supporting portion 70 in top cover 12 is placed on the holding plate 72 after the top cover 12 is opened may be provided, or a user may draw the movement supporting frame 61 with his/her hand after the front cover 13 is opened into a fully opened state.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing that has a top opening formed on a top face of the housing and a side opening formed on a side face of the housing;

an imaging device that is housed in the housing and that includes a photosensitive body, an exposure device which exposes the photosensitive body to form an electrostatic latent image on the photosensitive body, and a developing device which develops the electrostatic latent image with a developer on the photosensitive body;

a top cover that is movable between an open state opening the top opening and a close state closing the top opening, the exposure device being attached to an inner face of the top cover;

a moving device that is movable between a first position and second position through the side opening so as to draw a part of the imaging device mounted on the moving device, the first position being set inside the housing, the second position being set outside the housing; and a state holding device that keeps the top cover in the open state when the moving device is moved from the first position to the second position after the top cover is opened, wherein a tip of the exposure device is closer to the photosensitive body than an upper surface of the developing device.

2. The image forming apparatus according to claim 1, wherein the state holding device keeps the top cover in the open state when the moving device is moved a given distance from the first position to the second position.

3. The image forming apparatus according to claim 1, wherein the state holding device releases the top cover from keeping the open state when the moving device is moved to the first position.

4. The image forming apparatus according to claim 1 further comprising a movement regulating portion that holds a restriction state where the moving device is fixed to the first position when the top cover is in the close state and that releases the restriction state when the top cover is not in the close state.

5. The image forming apparatus according to claim 1, wherein the state holding device includes:

a supporting portion provided on the inner face of the top cover;

a holding member attached to the housing so as to be movable along a drawing direction from the first position to the second position, and having a holding face supportable the supporting portion on the holding face when the top cover is in the open state;

a pushing member provided between the housing and the holding member so as to urge the holding member along the drawing direction;

a stopping member provided in the housing and stopping the holding member urged by the pushing member at a position where the holding face is supportable the supporting portion; and a returning member provided in the moving device in a state where the returning member possibly contacts with the holding member, wherein the returning member is brought into contact with the holding member and moves the holding member so that the supporting portion is not supported by the holding face when the moving device is moved toward the first position.

6. The image forming apparatus according to claim 5 further comprising a movement operating member that moves the moving device to a position where the holding face is supportable the supporting portion after the top cover is put into the open state.

7. The image forming apparatus according to claim 5, wherein the holding member is moved to a position where the holding face is unsupportable the supporting portion when the moving device is pushed and is moved to the first position.

8. The image forming apparatus according to claim 5, wherein the moving device includes a contact face which is brought into contact with the supporting portion to prevent the moving device moving in the drawing direction when the top cover is in the close sate and the moving device is in the first position.

9. The image forming apparatus according to claim 1, wherein the part of the imaging device are detachably attached to the moving device, and the moving device includes an restriction unit that restricts detachment of the part of the imaging device from the moving device when the moving device is not in the second position and that releases the part of the imaging device from restriction of the detachment when the moving device is in the second position.

10. The image forming apparatus according to claim 1 further comprising a fixing device that fixes a developer image created by the imaging device onto a recording material, wherein the top cover rotates between the open state and the close state about a supporting shaft arranged on an opposite side to the drawing direction in the housing, the supporting shaft being arranged at a position above the fixing device.

11. The image forming apparatus according to claim 10, wherein the state holding device is disposed between the imaging device and the fixing device.

12. The image forming apparatus according to claim 10 further comprising an interlocking device that moves the moving device by a certain distance in the drawing direction in accordance with an opening operation of the top cover.

13. The image forming apparatus according to claim 1 further comprising a document reader configured to read an image to be imaged, wherein a certain space exists between the document reader and an external face of the top cover, and the state holding device keeps the top cover in the open state within the space.

14. The image forming apparatus according to claim 1, further comprising:

a front cover that covers the side opening, wherein the front cover moves independently of the top cover.

15. The image forming apparatus according to claim 1, wherein the developing devices is disposed on the moving device.

16. The image forming apparatus according to claim 1, wherein the top cover moves upward from the moving device when moving from the close state to the open state.

17. The image forming device according to claim 1, wherein the front cover is attached to the moving device such that the moving device moves to the second position in response to the front cover being opened.

* * * * *